US006624801B2

(12) United States Patent
Moriyama

(10) Patent No.: US 6,624,801 B2
(45) Date of Patent: Sep. 23, 2003

(54) DISPLAY APPARATUS AND PORTABLE ELECTRONIC APPARATUS THAT CAN REDUCE CONSUMPTIVE POWER, AND METHOD OF DRIVING DISPLAY APPARATUS

(75) Inventor: Hiroaki Moriyama, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 207 days.

(21) Appl. No.: 09/791,803

(22) Filed: Feb. 26, 2001

(65) Prior Publication Data

US 2001/0017611 A1 Aug. 30, 2001

(30) Foreign Application Priority Data

Feb. 28, 2000 (JP) ..... 2000/051706

(51) Int. Cl.[7] ..... G09G 3/36
(52) U.S. Cl. ..... 345/100; 345/103
(58) Field of Search ..... 345/100, 103, 345/94, 208, 99, 87, 92, 90, 93, 67, 98

(56) References Cited

U.S. PATENT DOCUMENTS

| | | | | |
|---|---|---|---|---|
| 5,754,160 A | * | 5/1998 | Shimizu et al. | 345/103 |
| 5,844,540 A | * | 12/1998 | Terasaki | 345/102 |
| 5,923,311 A | * | 7/1999 | Edwards | 345/92 |
| 6,437,767 B1 | * | 8/2002 | Cairns et al. | 345/100 |
| 6,466,193 B1 | * | 10/2002 | Anai | 345/99 |

FOREIGN PATENT DOCUMENTS

| | | |
|---|---|---|
| EP | 0 607 778 A1 | 7/1994 |
| EP | 0 852 371 A1 | 7/1998 |
| EP | 0 974 952 A1 | 1/2000 |
| JP | 63-243921 | 10/1988 |
| JP | 6-95621 | 4/1994 |
| JP | 7-152340 | 6/1995 |
| JP | 7-281632 | 10/1995 |
| JP | 9-5789 | 1/1997 |
| JP | 11-184434 | 7/1999 |
| JP | 11-271709 | 10/1999 |
| JP | 11-311980 | 11/1999 |
| JP | 11-311981 | 11/1999 |
| JP | 2001-202053 | 7/2001 |
| NL | 1002584 | 3/1999 |
| WO | WO 97/22036 | 6/1997 |

OTHER PUBLICATIONS

NEC Data Sheet MOS Integrated Circuit μPD16654, Doc. No. S11647EJ1V0DS00 (1st edition), 1998, pp. 1–16 (XP–002191258).

* cited by examiner

*Primary Examiner*—Vijay Shankar
*Assistant Examiner*—Nitin Patel
(74) *Attorney, Agent, or Firm*—Young & Thompson

(57) ABSTRACT

A display apparatus includes a plurality of scanning lines to which a plurality of scanning signals are inputted, respectively and a plurality of signal lines to which a plurality of display signals are inputted, respectively and a plurality of capacitance sections respectively provided through a plurality of switching elements at a plurality of intersections of the plurality of scanning lines and the plurality of signal lines, and a display section including the plurality of capacitance sections. The display section is divided into first and second display regions by a virtual line parallel to at least one of the plurality of scanning lines. The plurality of scanning signals are inputted at first intervals to a first group of the scanning lines corresponding to the first display region of the plurality of scanning lines. The plurality of scanning signals are inputted at second intervals different from the first intervals to a second group of the scanning lines corresponding to the second display region of the plurality of scanning lines.

18 Claims, 13 Drawing Sheets

EQUIVALENT CIRCUIT

EQUIVALENT CIRCUIT AT THE OFF
STATE OF THE TFT

DISPLAY APPARATUS AND PORTABLE ELECTRONIC APPARATUS THAT CAN REDUCE CONSUMPTIVE POWER, AND METHOD OF DRIVING DISPLAY APPARATUS

BACKGROUND OF THE INVENTION

1. Field of the Invention

The present invention relates to a display apparatus and a method of driving a display apparatus. More particularly, the present invention relates to a liquid crystal display and a method of driving a liquid crystal display.

2. Description of the Related Art

Conventionally, an STN (Super-Twist-Nematic) type of a liquid crystal display panel has been used in a display apparatus of a portable electronic apparatus such as a portable telephone, a mobile terminal and a pager. On the contrary, even the portable electronic apparatus recently begins to employ an active matrix drive method represented by a TFT (Thin-Film-Transistor) method suitable for a display apparatus of a color dynamic picture.

The portable electronic apparatus requires that a consumptive power is especially reduced since a large restriction is put on a battery capacity. The portable electronic apparatus does not require that an indication is carried out on a whole surface of a liquid crystal display panel, for example, in a wait time. It is sufficient to carry out a minimum indication such as a reception level, a battery remaining amount, a date and hour and the like. Thus, it may be considered to reduce the consumptive power at a section which does not require a usual indication on the liquid crystal display panel.

Conventionally, in a passive matrix drive type of a portable electronic apparatus represented by the STN type, the technique for reducing the consumptive power at the section which does not require the usual indication on the liquid crystal display panel is disclosed in the following conventional techniques 1 to 5.

Japanese Laid Open Patent Application (JP-A-Showa, 63-243921) (Conventional Technique 1) discloses the following liquid crystal display. A signal electrode of a matrix liquid crystal panel composed of a scan electrode and a signal electrode is divided into two regions. This is designed as follows. That is, it is driven such that in a period of a selective scan within one region in the two regions, the other region has a voltage non-application period and a non-selective voltage application period at a predetermined cycle. Also, the same voltage as the signal voltage applied to the signal electrode of the selective scan region is applied to the signal electrode of the region on which the selective scan is not performed, in the non-selective voltage application period.

Japanese Laid Open Patent Application (JP-A-Heisei, 6-95621) (Conventional Technique 2) discloses the following liquid crystal display controller. The liquid crystal display controller for controlling a display apparatus of a liquid crystal panel has a driver for dividing a display region of the liquid crystal panel into a plurality of partial display regions, and making a partial display region selected by an external control signal at a drive state and making the other partial display regions at a non-drive state.

Japanese Laid Open Patent Application (JP-A-Heisei, 7-281632) (Conventional Technique 3) discloses the following liquid crystal display. This has a common electrode in using an entire region of a liquid crystal display panel targeted for a display apparatus, a common electrode in using a partial region of the liquid crystal display panel having an effective peak value smaller than a drive voltage to a segment electrode, and a power supply circuit for switching and outputting the drive voltage to the segment electrode through an operation of a switch. It drives by switching between the segment electrode and the common electrode corresponding to the partial region or the entire region of the liquid crystal display panel, in accordance with the drive voltage from the power supply circuit.

Japanese Laid Open Patent Application (JP-A-Heisei, 11-311980) (Conventional Technique 4) discloses the following liquid crystal display controller. A drive bias selection register and a drive duty selection register that can be rewritten from a micro processor are mounted within the liquid crystal display controller. When it is switched from an entire indication on the liquid crystal display panel to only some lines, setting values of the drive duty selection register and the drive bias selection register are changed to selectively carry out the indication on a part of the liquid crystal display panel at a low voltage drive and a low duty drive.

Japanese Laid Open Patent Application (JP-A-Heisei, 11-311981) (Conventional Technique 5) discloses the following method of driving a liquid crystal display. The method of driving a liquid crystal display has a liquid crystal display panel having a displayable region generated in accordance with a plurality of scanning lines and a plurality of signal lines crossing each other and has a function of making only a part of the displayable region at a display state and making the other regions at a non-display state. In this method, a period is established for controlling a display gradation of a non-display region to attain the non-display state.

WO 97/22036 (Japanese Patent Application No. (Heisei) 9-518751) (Conventional Technique 6) discloses a method of driving a display apparatus. The number of voltage levels of scanning lines at a time of a non-selection is only one. If an indication through a display element is not carried out, a voltage level of a data line corresponding to the display element is used as a voltage level at the time of the non-selection of the scanning line.

The above-mentioned conventional techniques relate to the passive matrix drive method. Since its driving method is different, it can not be applied in its original state to the active matrix driving method.

It is desirable to attain a low consumptive power manner optimal for the driving method of the active matrix drive type.

SUMMARY OF THE INVENTION

The present invention is accomplished in view of the above mentioned problems.

Therefore, an object of the present invention is to provide a display apparatus that can reduce a consumptive power.

Another object of the present invention is to provide a display apparatus of an active matrix drive type represented by a TFT method that can reduce a consumptive power.

Still another object of the present invention is to provide a liquid crystal display apparatus that does not suffer from a bad influence caused by an application of a direct current voltage and can reduce a consumptive power. Still another object of the present invention is to provide a display apparatus of an active matrix drive type represented by a TFT method that does not suffer from a bad influence caused by an application of a direct current voltage and can reduce a consumptive power.

In order to achieve an aspect of the present invention, a display apparatus, includes: a plurality of scanning lines to which a plurality of scanning signals are inputted, respectively; a plurality of signal lines to which a plurality of display signals are inputted, respectively; a plurality of capacitance sections respectively provided through a plurality of switching elements at a plurality of intersections of the plurality of scanning lines and the plurality of signal lines; and a display section including the plurality of capacitance sections, and wherein the display section is divided into first and second display regions by a virtual line parallel to at least one of the plurality of scanning lines, and wherein the plurality of scanning signals are inputted at first intervals to a first group of the scanning lines corresponding to the first display region of the plurality of scanning lines, and wherein the plurality of scanning signals are inputted at second intervals different from the first intervals to a second group of the scanning lines corresponding to the second display region of the plurality of scanning lines.

In this case, the first intervals are selected such that the plurality of capacitance sections of the first display region are driven at alternating currents, and wherein the second intervals are selected such that the plurality of capacitance sections of the second display region are driven at alternating currents.

Also in this case, when the plurality of scanning signals are inputted to the second group of the scanning lines, the plurality of display signals inputted to the plurality of capacitance sections of the second display region have amplitudes substantially identical with each other.

Further in this case, when the plurality of scanning signals are not inputted to the second group of the scanning lines based on a difference between the first and second intervals, a plurality of specific display signals having amplitudes substantially identical with the amplitudes of the plurality of display signals inputted to the plurality of capacitance sections of the second display region when the plurality of scanning signals are inputted to the second group of the scanning lines, are outputted to the plurality of signal lines at the same timings as when the plurality of scanning signals are inputted to the second group of the scanning lines.

In this case, the amplitudes of the plurality of specific display signals are substantially zero.

Also in this case, when the plurality of scanning signals are not inputted to the second group of the scanning lines based on a difference between the first and second intervals, potentials of the plurality of signal lines are dropped at the same timings as when the plurality of scanning signals are inputted to the second group of the scanning lines.

Further in this case, when the plurality of scanning signals are not inputted to the second group of the scanning lines based on a difference between the first and second intervals, the plurality of signal lines are in floating states at the same timings as when the plurality of scanning signals are inputted to the second group of the scanning lines.

In this case, when the plurality of scanning signals are not inputted to the second group of the scanning lines based on a difference between the first and second intervals, potentials of the second group of the scanning lines are dropped at the same timings as when the plurality of scanning signals are inputted to the second group of the scanning lines.

Also in this case, the display apparatus, further includes: a first shift resister supplying the plurality of scanning signals to the first group of the scanning lines by transferring a first input signal one by one; and a second shift resister supplying the plurality of scanning signals to the second group of the scanning lines by transferring a second input signal one by one.

Further in this case, the display apparatus, further includes: a shift resister supplying the plurality of scanning lines to the plurality of scanning signals by transferring an input signal one by one, and wherein the shift resister has a switch to stop transferring the input signal such that the plurality of scanning signals are supplied to the first group of the scanning lines and the plurality of scanning signals are not supplied to the second group of the scanning lines.

In this case, the input signal is transferred in a predetermined direction in the shift resister, and wherein a first input section inputting the input signal is provided in the most upstream in the predetermined direction of the first group of the scanning lines in the shift resister, and wherein a second input section inputting the input signal is provided in the most upstream in the predetermined direction of the second group of the scanning lines in the shift resister.

Also in this case, each of the first and second intervals corresponds to a multiple of a period of a frame when a single image is displayed in the display section, and wherein the display apparatus further comprises: a control section detecting the number of the frames to switch between an ON state and an OFF state of the switch based on the detected result.

In order to achieve another aspect of the present invention, a display apparatus, includes: a plurality of scanning lines to which a plurality of scanning signals are inputted, respectively; a plurality of signal lines to which a plurality of display signals are inputted, respectively; a plurality of capacitance sections respectively provided through a plurality of switching elements at a plurality of intersections of the plurality of scanning lines and the plurality of signal lines; and a display section including the plurality of capacitance sections, and wherein the display section is divided into first, second and third display regions by two virtual lines parallel to at least one of the plurality of scanning lines, and wherein the plurality of scanning signals are inputted at first intervals to a first group of the scanning lines corresponding to the first display region of the plurality of scanning lines, and wherein the plurality of scanning signals are inputted at second intervals to a second group of the scanning lines corresponding to the second display region of the plurality of scanning lines, and wherein the plurality of scanning signals are inputted at third intervals to a third group of the scanning lines corresponding to the third display region of the plurality of scanning lines, and wherein at least one of the first, second and third intervals is different from a remaining one in a case that the at least one is withdrawn from the first, second and third intervals.

In this case, the switching element is one of a TFT (Thin-Film-Transistor) type and an MIM (Metal-Insulator-Metal) type.

Also in this case, the display apparatus is provided on a single substrate.

In order to achieve still another aspect of the present invention, a portable electronic apparatus having a display apparatus which includes: a plurality of scanning lines to which a plurality of scanning signals are inputted, respectively; a plurality of signal lines to which a plurality of display signals are inputted, respectively; a plurality of capacitance sections respectively provided through a plurality of switching elements at a plurality of intersections of the plurality of scanning lines and the plurality of signal lines;

and a display section including the plurality of capacitance sections, and wherein the display section is divided into first and second display regions by a virtual line parallel to at least one of the plurality of scanning lines, and wherein the plurality of scanning signals are inputted at first intervals to a first group of the scanning lines corresponding to the first display region of the plurality of scanning lines, and wherein the plurality of scanning signals are inputted at second intervals different from the first intervals to a second group of the scanning lines corresponding to the second display region of the plurality of scanning lines.

In order to achieve yet still another aspect of the present invention, a driving method of a display apparatus, includes: (a) providing a plurality of scanning lines to which a plurality of scanning signals are inputted, respectively; (b) providing a plurality of signal lines to which a plurality of display signals are inputted, respectively; (c) providing a plurality of capacitance sections respectively provided through a plurality of switching elements at a plurality of intersections of the plurality of scanning lines and the plurality of signal lines; (d) providing a display section including the plurality of capacitance sections; (e) dividing the display section into first and second display regions by a virtual line parallel to at least one of the plurality of scanning lines; (f) inputting the plurality of scanning signals at first intervals to a first group of the scanning lines corresponding to the first display region of the plurality of scanning lines; and (g) inputting the plurality of scanning signals at second intervals different from the first intervals to a second group of the scanning lines corresponding to the second display region of the plurality of scanning lines.

In this case, the first intervals are selected such that the plurality of capacitance sections of the first display region are driven at alternating currents, and wherein the second intervals are selected such that the plurality of capacitance sections of the second display region are driven at alternating currents.

Also in this case, when the plurality of scanning signals are inputted to the second group of the scanning lines, the plurality of display signals inputted to the plurality of capacitance sections of the second display region have amplitudes substantially identical with each other.

Further in this case, when the plurality of scanning signals are not inputted to the second group of the scanning lines based on a difference between the first and second intervals, a plurality of specific display signals having amplitudes substantially identical with the amplitudes of the plurality of display signals inputted to the plurality of capacitance sections of the second display region when the plurality of scanning signals are inputted to the second group of the scanning lines, are outputted to the plurality of signal lines at the same timings as when the plurality of scanning signals are inputted to the second group of the scanning lines.

The display apparatus of the present invention is based on the active matrix drive method, and has a plurality of regions having different refresh rates (a display rate, a write frequency and an gate-on period) on a single screen.

The active method is used to control the voltages applied to a scanning line of a second display region, a signal line, an opposite common electrode and a liquid crystal. Thus, it is possible to reduce a consumptive power and also possible to carry out a picture display (a middle between a static picture and a first display region) in which a picture change is smaller than that of a dynamic picture of the first display region (Since an accumulation voltage is dropped with an elapse of a time, a contrast of a picture may be dropped).

DESCRIPTION OF THE PREFERRED EMBODIMENTS

An embodiment of the present invention will be described below with reference to the attached drawings.

At first, a three-terminal device matrix drive method is described for using TFT as a conventionally typical switching device.

An operational principle of LCD (Liquid Crystal Display) based on an active matrix drive using a three-terminal device is described with reference to FIGS. 1, 2A~2F.

Figure 1A:
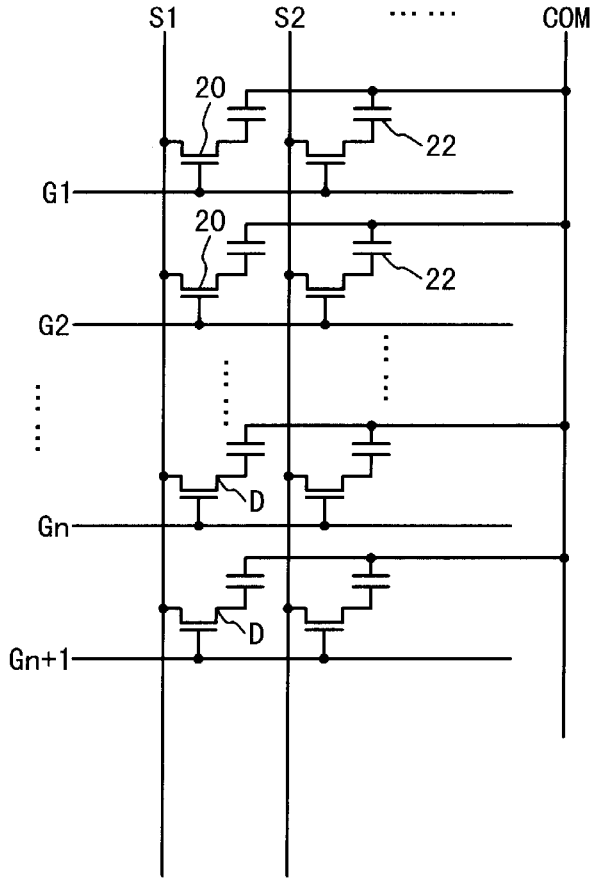
FIG. 1A is a circuit diagram showing a schematic circuit configuration of a typical TFT type LCD panel.

As shown in FIG. 1A, TFTs 20 are positioned at the intersections of matrix lines composed of scanning lines G1, G2, . . . Gn, Gn+1 . . . and signal lines S1, S2 . . . . Gate electrodes of the TFTs 20 are connected to the scanning lines G1, G2, . . . Gn, Gn+1 . . . . Their source electrodes are connected to the signal lines S1, S2 . . . . And, their drain electrodes D are connected to pixel electrodes. If the electrode is made of transparent metal, this is a transparent liquid crystal display using a light of a back light. If it is a reflective electrode, this is a reflective liquid crystal display using an external light. By the way, n is any integer equal to or greater than 2.

If a direct current voltage is applied to a liquid crystal for a long time, a deterioration phenomenon is induced such as a change in a material property and a drop of a specific resistance and the like. Thus, an alternating current drive is required from the viewpoint of a life of an LCD panel. So, a polarity of a drive voltage is inverted. For this reason, the polarity of the drive voltage is inverted for each frame (refresh).

As shown in FIGS. 1A, 2C~2F, a scanning signal is sent to the scanning lines G1, G2, . . . Gn, Gn+1 . . . by using a line sequence drive method. As shown in FIG. 2A, a parallel display signal (picture signal) whose polarity is inverted for each frame FT is sent to each of the signal lines S1, S2 . . . .

Figures 2A, 2B, 2C, 2D, 2E, 2F:
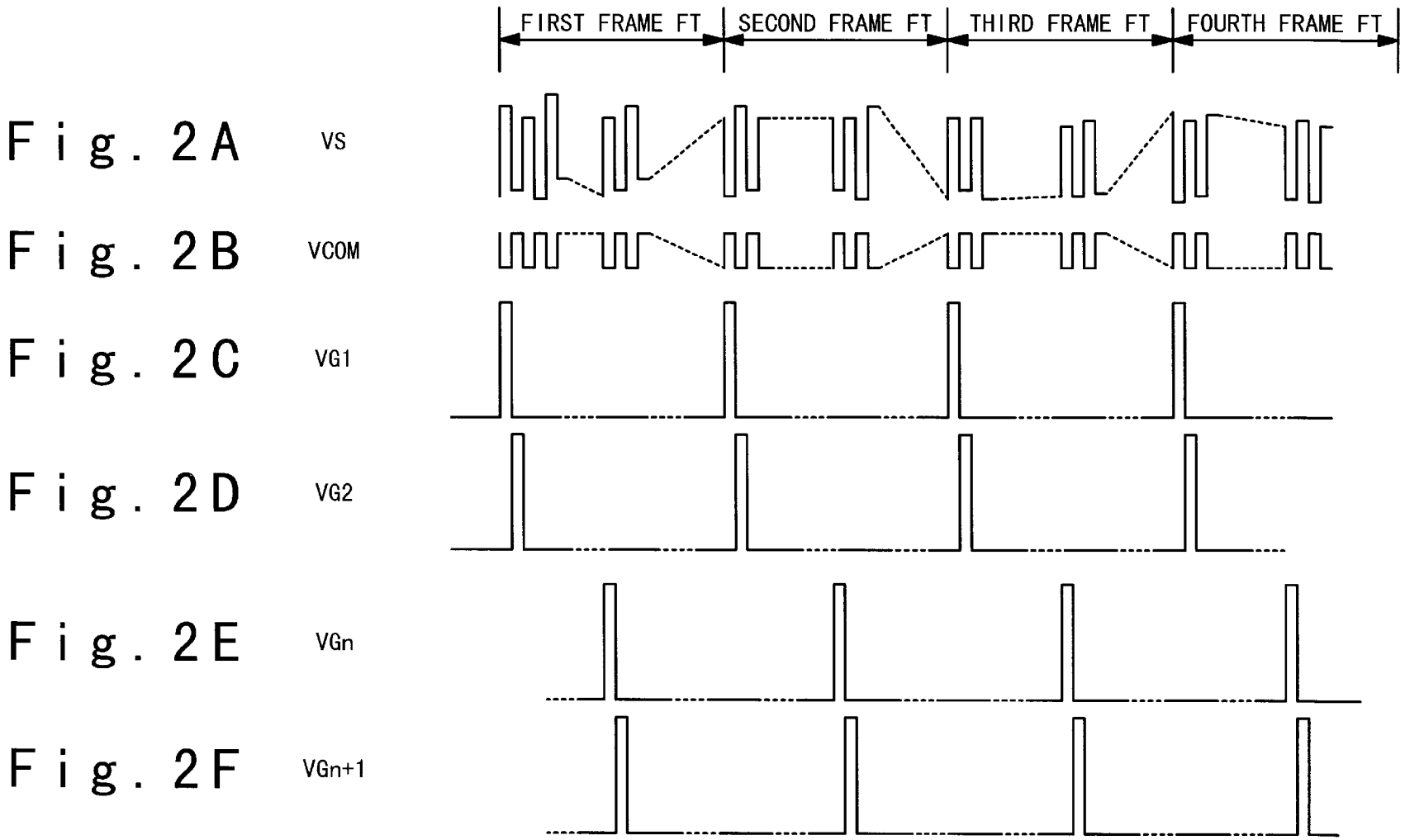
FIG. 2A is a timing chart showing a voltage of a display signal sent to a signal line in a method of driving a typical TFT type LCD panel.
FIG. 2B is a timing chart showing an opposite common voltage commonly sent to all pixel capacities in a method of driving a typical TFT type LCD panel.
FIG. 2C is a timing chart showing a voltage of a scanning signal VG1 sent to a scanning line G1 in a method of driving a typical TFT type LCD panel.
FIG. 2D is a timing chart showing a voltage of a scanning signal VG2 sent to a scanning line G2 in a method of driving a typical TFT type LCD panel.
FIG. 2E is a timing chart showing a voltage of a scanning signal VGn sent to a scanning line Gn in a method of driving a typical TFT type LCD panel.
FIG. 2F is a timing chart showing a voltage of a scanning signal VGn+1 sent to a scanning line Gn+1 in a method of driving a typical TFT type LCD panel.

A symbol VS of FIG. 2A denotes a voltage of a display signal sent to any one of the plurality of signal lines S1, S2 . . . (hereafter, one of them is described as the signal line S1). A symbol VCOM of FIG. 2B denotes an opposite common voltage that is commonly sent from an opposite common electrode COM to all pixel capacities 22 of the LCD panel, as shown in FIG. 1A. As shown in FIGS. 2A and 2B, each of the display signal and an opposite common signal (corresponding to the opposite common voltage VCOM) is driven at an alternating current. As shown in FIG. 2B, the opposite common signal whose polarity is inverted for each frame FT is sent to the opposite common electrode COM.

The display signal is written to the capacitor 22 of each pixel (the capacitor 22 includes both a liquid crystal capacitor and an accumulation capacitor) through a TFT switch 20 that is controlled to be turned on and off, in accordance with the scanning signal. A liquid crystal on each pixel electrode is operated on the basis of a potential difference between a pixel electrode voltage VD corresponding to the display signal and the opposite common voltage VCOM at that time.

The operation for writing the display signal to the pixel electrode (capacitor 22) is carried out by using a method of sampling a parallel display signal to be simultaneously sent to the signal lines S1, S2 . . . by using a scanning signal to be sequentially sent to the plurality of scanning lines G1, G2, Gn, Gn−1 . . . (Line Sequence Drive).

As for the display signal written to the pixel electrode, a next scanning signal is inputted after one frame FT from the execution of its write operation. Until a display signal whose polarity (with the opposite common voltage VCOM as a standard) is written to an already written display signal in response to the input scanning signal, a potential of the already written display signal is maintained. So, the liquid crystal is driven at a semi-static state.

The polarity of the display signal sent to a signal line S1 is inverted for each frame FT. As shown in FIG. 2A, as for a pixel electrode voltage VD corresponding to a voltage of the display signal sent to the signal line S1, at its lead (a voltage applied to a capacitor 22 connected through the TFT switch 20 to the scanning line G1 at a highest order), a positive write is performed on a first frame FT, a negative write is performed on a second frame FT, a positive write is performed on a third frame FT, and a negative write is performed on a fourth frame FT. Hereafter, it is similarly done.

Figure 1B:
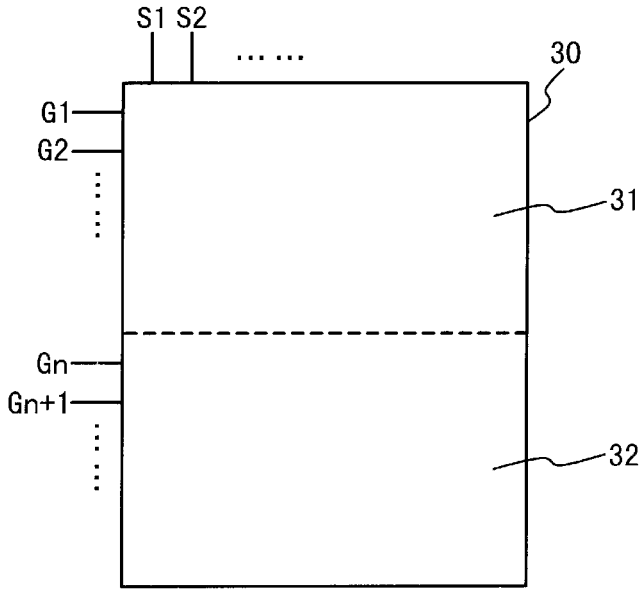
FIG. 1B is a view when the LCD panel of FIG. 1A is divided into two sections.

As shown in FIG. 1B, an LCD panel 30 is divided into an upper half (first display region) 31 and a lower half (second display region) 32, and it is driven. The first display region 31 is in a range between the scanning lines G1, G2, . . . , Gn−1. The second display region 32 is in a range between the scanning lines Gn, Gn+1 . . . .

If it is desired to display a picture having a small picture change on the first display region 31 and display a usual picture on the second display region 32 and accordingly reduce a consumptive power, the second display region 32 is intermittently driven to thereby reduce the consumptive power. For example, let us suppose that a date and hour and a battery remaining amount are usually displayed on the first display region 31 having a narrow area, and on the other hand, let us suppose that an antenna indication or a white screen indication is displayed on the second display region 32 having a wide area, at a wait time except the usual usage time. Accordingly, the intermittent drive of the second display region 32 at the wait time enables the consumptive power to be reduced.

The time band, in which the picture of the second display region 32 is not changed in picture, does not require that the scanning signal is sent to the scanning lines Gn, Gn+1 . . . of the second display region 32. In the time band, a display signal when a scanning signal is sent to the scanning lines Gn, Gn+1 . . . immediately before the time band is held in a capacity section 22 of the second display region 32. For example, if a voltage of the display signal when the scanning signal is sent to the scanning lines Gn, Gn+1 . . . is equal to or less than a threshold and immediately after its supply, the scanning signal is not sent to the scanning lines Gn, Gn+1 . . . , the screen of the second display region 32 is kept white when a liquid crystal of each pixel is a normally white type.

As mentioned above, according to the method in which the scanning signal is not sent to the second display region 32 (scanning lines Gn, Gn+1 . . . ), the consumptive power can be surely reduced.

However, as described below in detail, the inventor discovers the fact that the continuation of the condition in which the scanning signal is not merely inputted to the scanning line may cause a direct current voltage to be applied to the liquid crystal and result in the deterioration phenomenon such as the change of the material property and the drop of the specific resistance and the like.

A TFT type LCD has a parasitic resistance, and a leak current is induced from a pixel potential. Thus, the pixel potential is not always attenuated in a direction of a zero volt, in both the positive write and the negative write such as a field through voltage and the like. There may be a case that an unexpected direct current voltage is applied to the liquid crystal, and this case leads to a factor of a deterioration. For this reason, even in the second display region 32 in which the consumptive power is reduced, it is not desirable to stop the supply of the scanning signal for a long time. It is necessary that the scanning signal is sent even if the write period is long.

Figure 8:
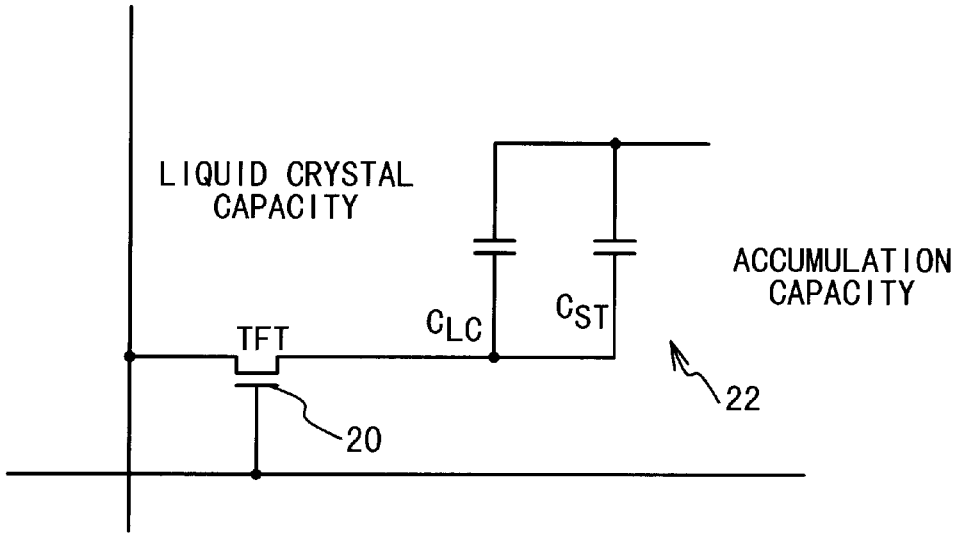
FIG. 8 is a view showing a circuit configuration of a pixel portion of a TFT type LCD at an ideal state.

The pixel section of the TFT type LCD may be ideally illustrated as shown in FIG. 8. Thus, if it is at the ideal state, when the TFT 20 is at an off-state, the TFT 20 serving as a switch is made at an open state. Hence, a liquid crystal voltage VLC is held which is written to a liquid crystal capacitor CLC and an accumulation capacitor CST. Here, the liquid crystal voltage VLC corresponds to a potential difference between the pixel electrode voltage VD and the opposite common voltage VCOM.

Figure 9:
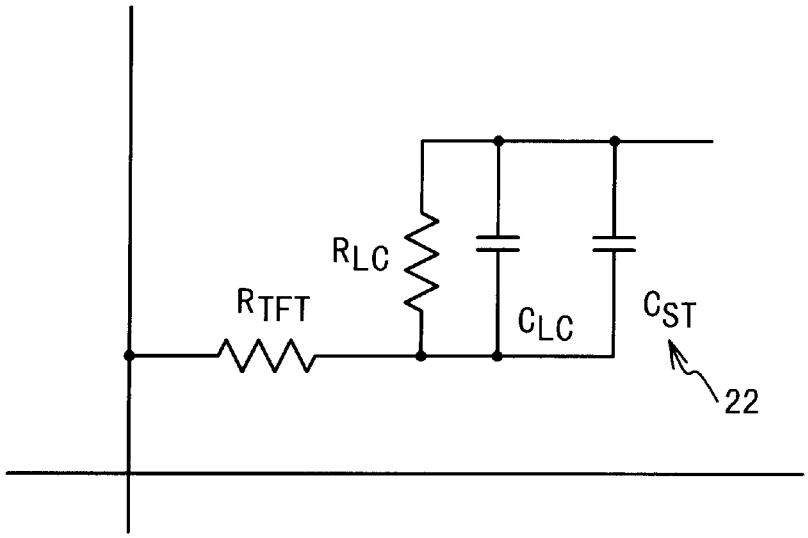
FIG. 9 is a view showing an actual equivalent circuit when TFT is at an off-state.

However, an off-resistance RTFT of the TFT 20 is not infinite. Moreover, the capacitor section of the liquid crystal also has a finite resister value RLC. An actual equivalent circuit when the TFT 20 is at the off-state is illustrated as shown in FIG. 9. Thus, charges written to the liquid crystal capacitor CLC and the accumulation capacitor CST are discharged through the resistor RLC. Also, they are discharged or charged through the resistance RTFT (since the potential of the signal line is changed on the basis of the picture (display) signal that is momentarily changed, both the discharging and charging actions are done in the resistance RTFT).

Here, when the pixel section is observed (except the TFT 20), a discharge time constant τ can be represented by the following equation:

$$\tau = RLC \times (CLC + CST)$$

If the influence from only the resistor value RLC of the liquid crystal capacitor section is considered, it is enough to increase the value of the accumulation capacitor CST. However, as the capacitance of the accumulation capacitor CST is made greater, a load on the TFT 20 is made greater. Thus, it is necessary to improve a current supply ability of the TFT 20, in proportion to the load. This results in the drop of the off resistance RTFT in the TFT 20. As a result, the suppression of the discharging/charging phenomenon can not be expected at the RTFT section.

Also, there may be a case that the off resistance RTFT of the TFT 20 does not exhibit a merely linear resistive property because of a fluctuation of a process for manufacturing the TFT 20 and exhibits a non-linear property in which the property is changed depending on a voltage and a polarity. Thus, it is impossible to expect the simply discharging/charging property.

As a result, the continuation of the off-state of the TFT 20 causes the voltages written to the liquid crystal capacitor CLC and the accumulation capacitor CST to be gradually changed. The direction of the change is not uniform. The continuation of this changed state causes the direct current voltage to be continuously applied to the liquid crystal. Thus, there may be a fear that the molecules of the liquid crystal within the liquid crystal panel and the related material are dissolved to thereby bring about the aging deterioration.

In the conventional method of using the TFT type LCD (for example, the write at 60 Hz), both the resistor value RLC of the liquid crystal capacitor and the off resistance RTFT of the TFT 20 are sufficiently large. Thus, there is no problem with regard to the discharging/charging action.

However, in order to reduce the consumptive power, only keeping the TFT 20 at the off-state may have a bad influence on the liquid crystal.

Thus, this embodiment uses the feature of the hold device for holding the voltage at which the TFT type LCD is written, and makes the write period longer and drives it, and accordingly attains both the maintenance of the original reliability and the reduction in the consumptive power. In this case, the fact that the liquid crystal driven at the long write period needs to be driven at the alternating current is similar to that of the liquid crystal driven at the usual write period.

The operational principle in this embodiment is described with reference to FIGS. 3A~3F.

FIGS. 3A~3F show a case in which a picture of the second display region 32 is not changed in picture (including a case that the entire surface of the second display region 32 is still kept white).

Instead of the above-mentioned case, this embodiment may be a case that a picture corresponding to a lengthened write period (this picture has the picture change smaller than that of the picture of the first display region 31 of the usual write period) is displayed on the second display region 32.

Figures 3A, 3B, 3C, 3D, 3E, 3F:
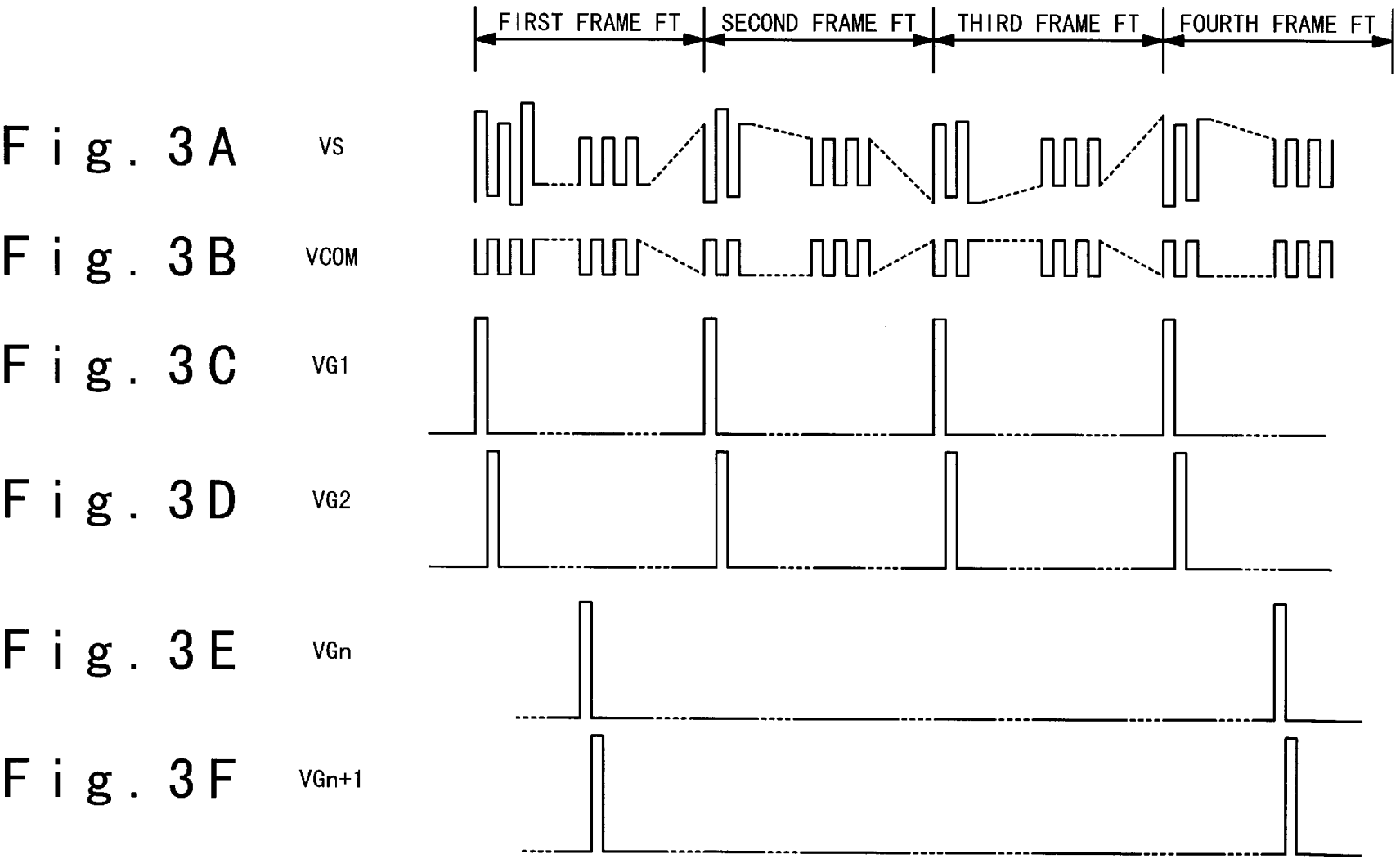
FIG. 3A is a timing chart showing a voltage of a display signal sent to a signal line in a method of driving a TFT type LCD panel of an embodiment of a display apparatus of the present invention.
FIG. 3B is a timing chart showing an opposite common voltage commonly sent to all pixel capacities in a method of driving a TFT type LCD panel of an embodiment of a display apparatus of the present invention.
FIG. 3C is a timing chart showing a voltage of a scanning signal VG1 sent to a scanning line G1 in a method of driving a TFT type LCD panel of an embodiment of a display apparatus of the present invention.
FIG. 3D is a timing chart showing a voltage of a scanning signal VG2 sent to a scanning line G2 in a method of driving a TFT type LCD panel of an embodiment of a display apparatus of the present invention.
FIG. 3E is a timing chart showing a voltage of a scanning signal VGn sent to a scanning line Gn in a method of driving a TFT type LCD panel of an embodiment of a display apparatus of the present invention.
FIG. 3F is a timing chart showing a voltage of a scanning signal VGn+1 sent to a scanning line Gn+1 in a method of driving a TFT type LCD panel of an embodiment of a display apparatus of the present invention.

In FIGS. 3A and 3B, each of the display signal and the opposite common signal is driven at the alternating current, similarly to FIGS. 2A and 2B. The polarity of each pixel is inverted for each refresh.

At first, a first frame FT is described.

As shown in FIG. 3E, in the first frame FT, a scanning signal VGn is sent to the scanning line Gn of the second display region 32 at the usual timing (the timing equal to that of FIG. 2). Similarly, as shown in FIG. 3F, in the first frame FT, a scanning signal VGn+1 is sent to the scanning line Gn+l of the second display region 32 at the usual timing (the timing equal to that of FIG. 2). That is, in the first frame FT, the scanning signals are sequentially inputted to all the scanning lines G1, G2, . . . Gn, Gn+1 . . . of the LCD panel 30. Thus, not only the first display region 31 but also the second display region 32 is driven.

In FIGS. 3A, 3K and 3K, a voltage VS of a display signal sent to a liquid crystal capacitor 22 connected through the TFT 20 to the scanning line Gn when the scanning signal VGn is sent to the scanning line Gn and a voltage VS of a display signal sent to a liquid crystal capacitor 22 connected through the TFT 20 to the scanning line Gn+1 when the scanning signal VGn+1 is sent to the scanning line Gn+1 are different from each other in polarity and equal to each other in amplitude.

When the scanning signal VGn is sent to the scanning line Gn and when the scanning signal VGn+1 is sent to the scanning line Gn+1, the values of the voltages applied to the respective capacitors 22 are equal to each other (an absolute value of a potential difference between the VD and the VCOM). If a voltage at each pixel is equal to or smaller than a threshold of the liquid crystal, each pixel is white when the liquid crystal of each pixel is a normally white type. Moreover, its gradation is the same.

The above-mentioned explanation is described with regard to the scanning lines Gn, Gn+1. The operation in the above-mentioned explanation is repeated for the scanning lines Gn+2, Gn+3, . . . .

That is, the scanning signals VGn+2, VGn+3, . . . , are sent to the scanning lines Gn+2, Gn+3, . . . , by using the line sequence drive method, similarly to FIGS. 2E and 2F. A voltage VS of a display signal sent to a liquid crystal capacitor 22 connected through the TFT 20 to the scanning line Gn+2 when the scanning signal VGn+2 is sent to the scanning line Gn+2 and a voltage VS of a display signal sent to a liquid crystal capacitor 22 connected through the TFT 20 to the scanning line Gn+3 when the scanning signal VGn+3 is sent to the scanning line Gn+3 are different from each other in polarity and equal to each other in amplitude.

Here, the voltage VS of the display signal sent to the liquid crystal capacitor 22 connected through the TFT 20 to the scanning line Gn+2 when the scanning signal VGn+2 is sent to the scanning line Gn+2 and the voltage VS of the display signal sent to the liquid crystal capacitor 22 connected through the TFT 20 to the scanning line Gn+1 when the scanning signal VGn+1 is sent to the scanning line Gn+1 are different from each other in polarity and equal to each other in amplitude.

When the scanning signal VGn+1 is sent to the scanning line Gn+1, when the scanning signal VGn+2 is sent to the scanning line Gn+2 and when the scanning signal VGn+3 is sent to the scanning line Gn+3, the values of the voltages applied to the respective capacitors 22 are equal to each other (the absolute value of the potential difference between the VD and the VCOM) They are equal to or less than the threshold of the liquid crystal of each pixel. Thus, each pixel becomes white in the same graduation.

The above-mentioned display signal VS shown in FIG. 3A corresponds to any one of the plurality of signal lines S1, S2 . . . (here, it is assumed to be the signal line S1) As for the other signal lines (here, they are assumed to be the signal liens S2, S3 . . . ), when the scanning signals VGn, VGn+1 are sent to the scanning lines Gn, Gn+1, the value of the display signal sent to each of the liquid crystal capacitors 22 connected through the TFTs 20 to the scanning lines Gn, Gn+1 is equal to any one of the above-mentioned signal lines (signal line S1).

From the above-mentioned explanation, the whole of the second display region 32 is white in the same gradation.

The second frame FT will be described below.

As shown in FIGS. 3C and 3D, in the second frame FT, the scanning signal VG1, VG2, VGn−1 . . . are sent to the scanning lines G1, G2, . . . Gn−1 of the first display region 31, similarly to FIGS. 2C and 2D. On the other hand, in the second frame FT, the pulses for turning the TFTs on, such as the scanning signals VGn, VGn+1, are not sent to the scanning lines Gn, Gn+1 of the second display region 32, differently from FIGS. 2E and 2F. Thus, in the second frame FT, all the TFTs 20 of the second display region 32 are at the off-state (the second display region 32 is not driven). Hence, a new voltage (the potential difference between the VD and the VCOM) is never applied to each of the liquid crystal capacitors 22 of the second display region 32.

In the first frame FT, the voltage applied in the first frame FT is held in each of the liquid crystal capacitors 22 of the second display region 32. Thus, the respective pixels of the second display region 32 are white in the same graduation. In the second frame FT, the charges accumulated in the respective liquid crystal capacitors 22 of the second display region 32 may be slightly discharged with an elapse of a time, as compared with the first frame FT. However, if the discharge amount is equal to or less than the threshold voltage of the liquid crystal, it is no problem on the actual usage.

In the second frame FT, all the TFTs 20 of the second display region 32 are at the off-state (not driven). Thus, each of the voltage VS of the display signal and the opposite common voltage VCOM, which correspond to each liquid crystal capacity 22 (the scanning lines Gn, Gn+1 . . . ) of the second display region 32 has no relation to the picture (color) of the second display region 32. In this embodiment, the liquid crystal voltage VLC of each pixel of each liquid crystal capacitor 22 of the second display region 32 in the second frame FT is equal to the liquid crystal voltage VLC of each pixel corresponding to each liquid crystal capacitor 22 of the second display region 32 in the first frame FT (fixed from the first frame FT).

The third frame FT will be described below.

In the third frame VT, the second display region 32 is not driven similarly to the second frame FT. The operation with regard to the second display region 32 is equal to that of the second frame FT. The condition of the second display region 32 is equal to that of the second frame FT. In the third frame FT, the charges accumulated in the respective liquid crystal capacitors 22 of the second display region 32 may be slightly discharged with an elapse of a time, as compared with the second frame FT. However, if the discharge amount is equal to or less than the threshold voltage of the liquid crystal, it is no problem on the actual usage.

The fourth frame FT will be described below.

In the fourth frame FT, the second display region 32 is driven similarly to the first frame FT. The operation with regard to the second display region 32 is equal to that of the first frame FT except the following points.

As shown in FIGS. 3A, 3E and 3F, in the first frame FT, the voltage VS of the display signal sent to the liquid crystal capacitor 22 connected through the TFT 20 to the scanning line Gn when the scanning signal VGn is sent to the scanning line Gn is the positive potential (with the opposite common voltage VCOM as the standard). The voltage VS of the display signal sent to the liquid crystal capacitor 22 connected through the TFT 20 to the scanning line Gn+1 when the scanning signal VGn+1 is sent to the scanning line Gn+1 is the negative potential (with the opposite common voltage VCOM as the standard.

On the contrary, the polarity of each voltage VS of the fourth frame FT is opposite to that of the first frame FT. That is, in the fourth frame FT, the voltage VS of the display signal sent to the liquid crystal capacitor 22 connected through the TFT 20 to the scanning line Gn when the scanning signal VGn is sent to the scanning line Gn is the negative potential (with the opposite common voltage VCOM as the standard). The voltage VS of the display signal sent to the liquid crystal capacitor 22 connected through the TFT 20 to the scanning line Gn+1 when the scanning signal VGn+1 is sent to the scanning line Gn+1 is the positive potential (with the opposite common voltage VCOM as the standard).

From the above-mentioned explanation, the liquid crystal of each pixel in the second display region 32 is driven at the alternating current between the first frame FT and the fourth frame FT.

In the fourth frame FT, the voltage VS of the display signal sent to the liquid crystal capacitor 22 connected through the TFT 20 to the scanning line Gn when the scanning signal VGn is sent to the scanning line Gn and the voltage VS of the display signal sent to the liquid crystal capacitor 22 connected through the TFT 20 to the scanning line Gn+1 when the scanning signal VGn+1 is sent to the scanning line Gn+1 are different from each other in polarity and equal to each other in amplitude, similarly to the first frame FT.

When the scanning signal VGn is sent to the scanning line Gn and when the scanning signal VGn+1 is sent to the scanning line Gn+1, the values of the voltages applied to the respective capacitors 22 are equal to each other (the absolute value of the potential difference between the VD and the VCOM). Each of the values is equal to or less than the threshold of the liquid crystal of each pixel. The above-mentioned explanation is described with regard to the scanning lines Gn, Gn+1. The operation in the above-mentioned explanation is repeated for the scanning lines Gn+2, Gn+3, . . . Thus, the respective liquid crystal capacitors 22 of the second display region 32 are only different from each other in polarity. So, they are driven similarly to the first frame FT. Each pixel of the second display region 32 is white in the same graduation as the first from FT.

The fifth frame FT (not shown) will be described below.

The operation with regard to the second display region 32 in the fifth frame FT is equal to that of the second frame FT. The liquid crystal voltage VLC of each pixel corresponding to each liquid crystal capacitor 22 of the second display region 32 in the fifth frame FT is assumed to be equal to the liquid crystal voltage VLC of each pixel corresponding to each liquid crystal capacitor 22 of the second display region 32 in the fourth frame FT (fixed from the fourth frame FT).

The operation with regard to a second display region 32 in a sixth frame FT (not shown) is equal to that of the third frame FT. The operation with regard to a second display region 32 in a seventh frame FT (not shown) is equal to that of the first frame FT. And, the operations on and after an eighth frame FT (not shown) are also similar to those of the above-mentioned frames FT.

In the above-mentioned embodiment, the second display region 32 is driven in the fourth frame FT after the first frame FT. This is because the liquid crystal of each pixel of the second display region 32 is driven at the alternating current between the first frame FT and the fourth frame FT.

If the liquid crystal of each pixel of the second display region 32 can be driven at the alternating current, the frame FT in which the second display region 32 is driven can be replaced by the above-mentioned frame FT. For example, in FIGS. 3A, 3E and 3F, the second display region 32 can be driven in the fourth frame FT and the sixth frame FT after the first frame FT and the third frame FT. According to this manner, in the first and third frames FT, the voltage VS of the display signal sent to the liquid crystal capacitor 22 connected through the TFT 20 to the scanning line Gn when the scanning signal VGn is sent to the scanning line Gn is the positive potential (with the opposite common voltage VCOM as the standard). The voltage VS of the display signal sent to the liquid crystal capacitor 22 connected through the TFT 20 to the scanning line Gn+1 when the scanning signal VGn+1 is sent to the scanning line Gn+1 is the negative potential (with the opposite common voltage VCOM as the standard). On the contrary, the polarities of the respective voltages VS of the fourth and sixth frames FT are opposite to those of the first and third frames FT. That is, in the fourth frame FT, the voltage VS of the display signal sent to the liquid crystal capacitor 22 connected through the TFT 20 to the scanning line Gn when the scanning signal VGn is sent to the scanning line Gn is the negative potential (with the opposite common voltage VCOM as the standard). The voltage VS of the display signal sent to the liquid crystal capacitor 22 connected through the TFT 20 to the scanning line Gn+1 when the scanning signal VGn+1 is sent to the scanning line Gn+1 is the positive potential (with the opposite common voltage VCOM as the standard). Thus, from the above-mentioned explanation, the liquid crystals of the respective pixels in the second display regions 32 are driven at the alternating current between the first and third frames FT and between the fourth and sixth frames FT.

As mentioned above, in this embodiment, the write periods on and after the scanning signal VGn (VGn, VGn+1 . . . ) in the second display region 32 are longer (a display rate is lower) than those of FIGS. 2E and 2F. Thus, the consumptive power can be reduced correspondingly to it. The write period of the second display region 32 shown in FIGS. 3E and 3F is equal to three times that of FIGS. 2E and 2F. In the TFT type LCD, the charges accumulated in the liquid crystal capacitor 22 are held until a next write timing. Thus, if the low display rate is allowable such as the second display region 32, it can be driven in the write period in which the alternating current drive can be attained, on the basis of the display rate.

In the above-mentioned embodiment, as for the voltages VS of the display signals applied to the respective signal lines S1, S2 . . . at the time of the drive of the second display region 32, their amplitudes are set to be equal to each other so that the uniform voltage having the positive and negative polarities are applied to the respective liquid crystal capacitors 22 between the respective scanning lines Gn, Gn+1 . . . together with the opposite common voltages VCOM. This is because the respective pixels are made white (or, black or the like) in the same graduation. If the graduation is not severely considered, instead of the above-mentioned case, the voltages VS of the display signals applied to the respective signal lines S1, S2 . . . at the time of the drive of the second display region 32 may be the voltages of the original picture (display) signals which are not always equal to each other in amplitude.

In the above-mentioned embodiment, when the second display region 32 is not driven (for example, in the second and third frames FT), the signal voltages VS sent to the TFTs 20 connected to the scan electrodes on and after the scan electrode Gn (Gn, Gn+1 . . . ) are set to be equal (fixed) to those when the second display region 32 is driven (for example, the first frame FT). Instead of it, when the second display region 32 is not driven, the potentials of the signal lines S1, S2 . . . can be removed or set at a floating state (a high impedance state) at a timing when they are sent to the second display region 32. That is, it is possible to transiently stop the supply of a power supply to a driver IC for driving the signal lines S1, S2 . . . or mount an on/off switching switch at former stages of the signal lines S1, S2 . . . .

In the above-mentioned embodiments, it is assumed that the scanning lines Gn, Gn+1 . . . at the time of the drive of the second display region 32 are scanned by using the line sequence scan manner. Instead of this manner, the number of interlaced scanning lines may be plural. Also, on the side of the scanning line, when the second display region 32 is not driven, the potentials corresponding to the scanning lines Gn, Gn+1 . . . may be removed.

Figures 10A, 10B, 10C, 10D, 10E, 10F:
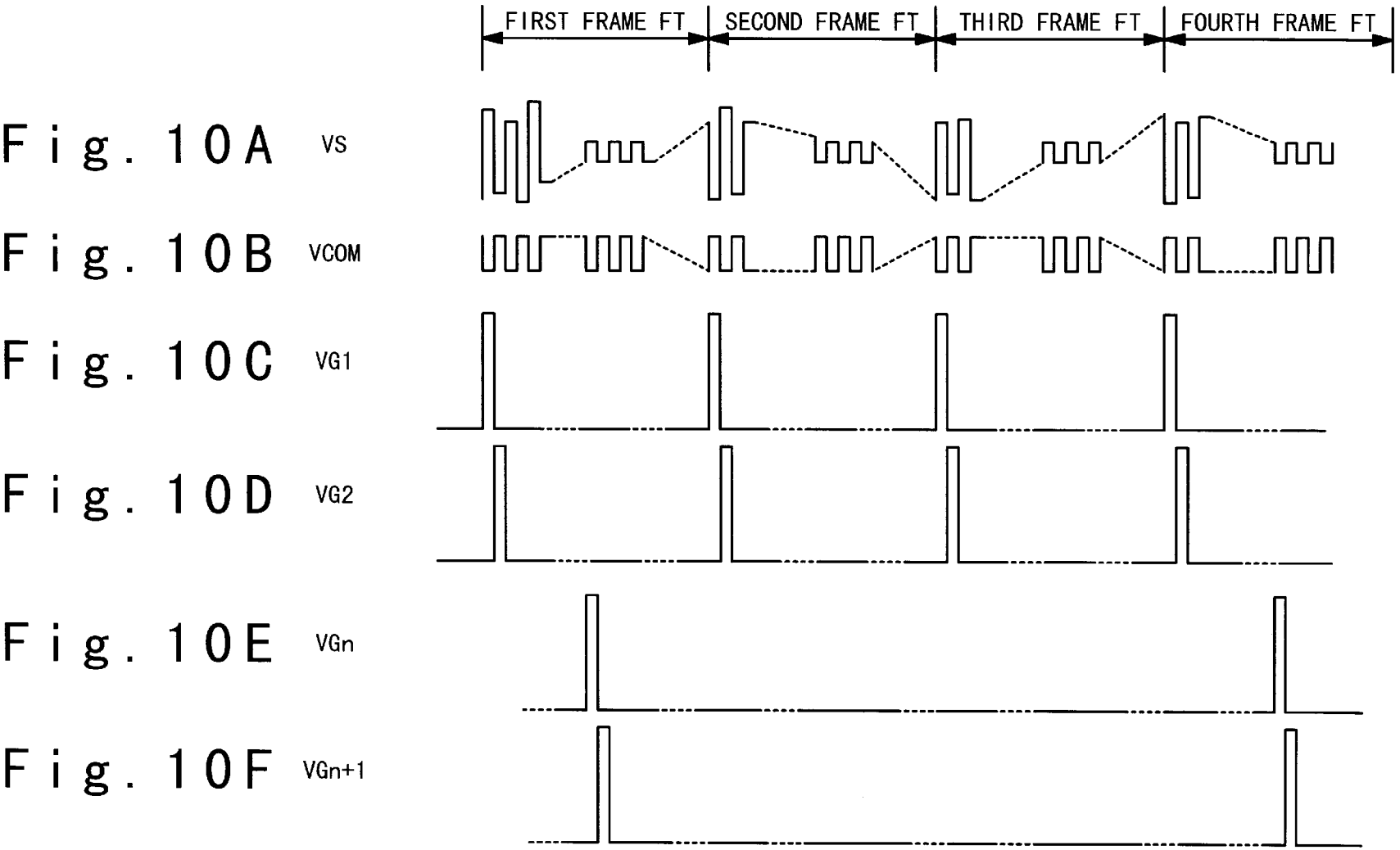
FIG. 10A is a timing chart showing a voltage of a display signal sent to a signal line in another method of driving a TFT type LCD panel of an embodiment of a display apparatus of the present invention.
FIG. 10B is a timing chart showing an opposite common voltage commonly sent to all pixel capacities in another method of driving a TFT type LCD panel of an embodiment of a display apparatus of the present invention.
FIG. 10C is a timing chart showing a voltage of a scanning signal VG1 sent to a scanning line G1 in another method of driving a TFT type LCD panel of an embodiment of a display apparatus of the present invention.
FIG. 10D is a timing chart showing a voltage of a scanning signal VG2 sent to a scanning line G2 in another method of driving a TFT type LCD panel of an embodiment of a display apparatus of the present invention.
FIG. 10E is a timing chart showing a voltage of a scanning signal VGn sent to a scanning line Gn in another method of driving a TFT type LCD panel of an embodiment of a display apparatus of the present invention.
FIG. 10F is a timing chart showing a voltage of a scanning signal VGn+1 sent to a scanning line Gn+1 in another method of driving a TFT type LCD panel of an embodiment of a display apparatus of the present invention.

In the second display region 32, the consumptive power can be further reduced when the voltage VS of the display signal is not changed if possible. In view of this point, if the liquid crystal of each pixel of the second display region 32 is the normally white type, and the voltage equal to or less than the threshold is applied to each pixel, and it is made white, the amplitude can be made further lower than that of the example of FIG. 3A, as shown in FIG. 10A.

Figures 11A, 11B, 11C, 11D, 11E, 11F:
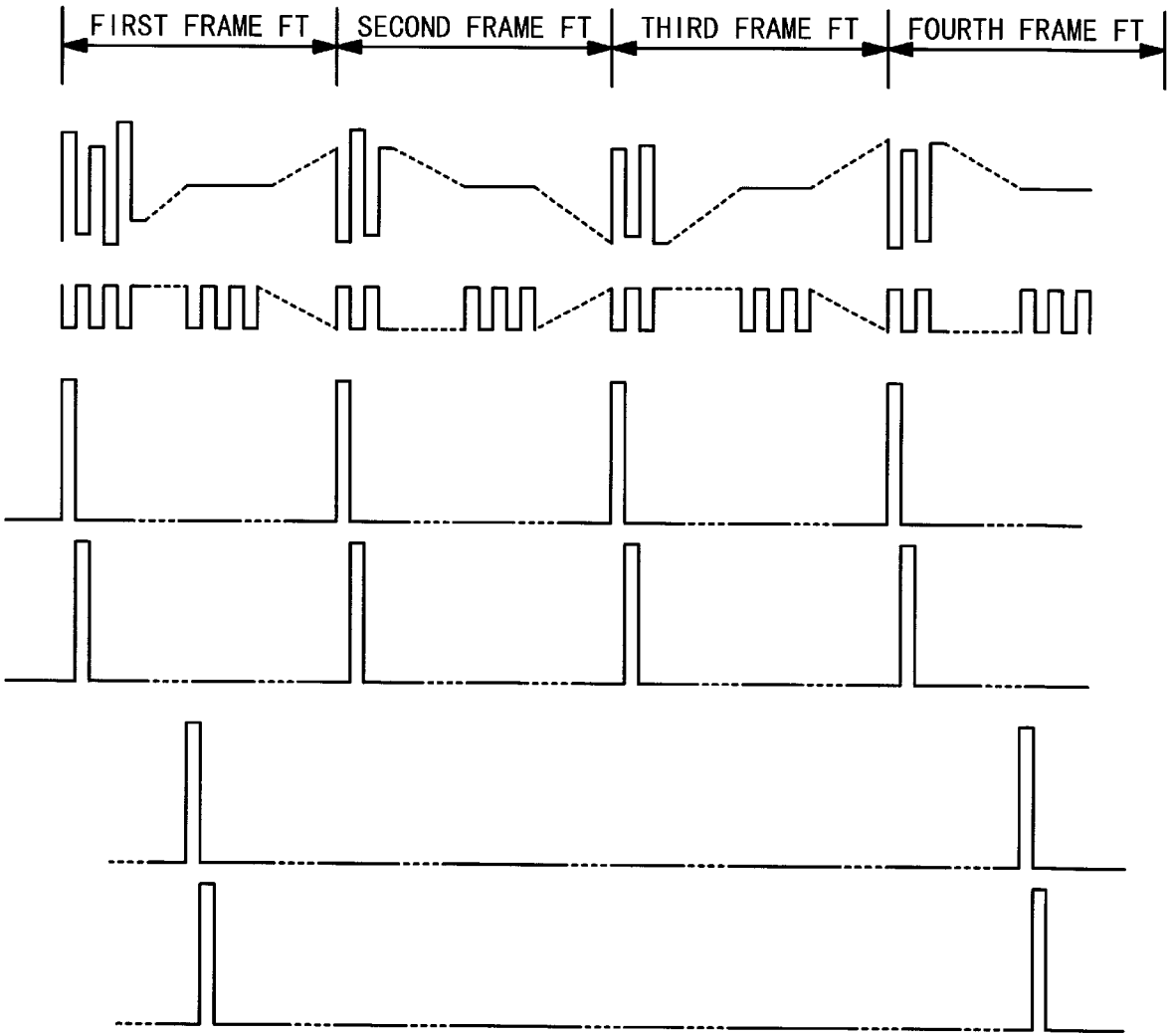
FIG. 11A is a timing chart showing a voltage of a display signal sent to a signal line in still another method of driving a TFT type LCD panel of an embodiment of a display apparatus of the present invention.
FIG. 11B is a timing chart showing an opposite common voltage commonly sent to all pixel capacities in still another method of driving a TFT type LCD panel of an embodiment of a display apparatus of the present invention.
FIG. 11C is a timing chart showing a voltage of a scanning signal VG1 sent to a scanning line G1 in still another method of driving a TFT type LCD panel of an embodiment of a display apparatus of the present invention.
FIG. 11D is a timing chart showing a voltage of a scanning signal VG2 sent to a scanning line G2 in still another method of driving a TFT type LCD panel of an embodiment of a display apparatus of the present invention.
FIG. 11E is a timing chart showing a voltage of a scanning signal VGn sent to a scanning line Gn in still another method of driving a TFT type LCD panel of an embodiment of a display apparatus of the present invention.
FIG. 11F is a timing chart showing a voltage of a scanning signal VGn+1 sent to a scanning line Gn+1 in still another method of driving a TFT type LCD panel of an embodiment of a display apparatus of the present invention.

Moreover, as shown in FIG. 11A, the consumptive power can be further reduced by setting the amplitude of the voltage VS of the display signal at zero, in the second display region 32.

Figures 12A, 12B, 12C, 12D, 12E, 12F:
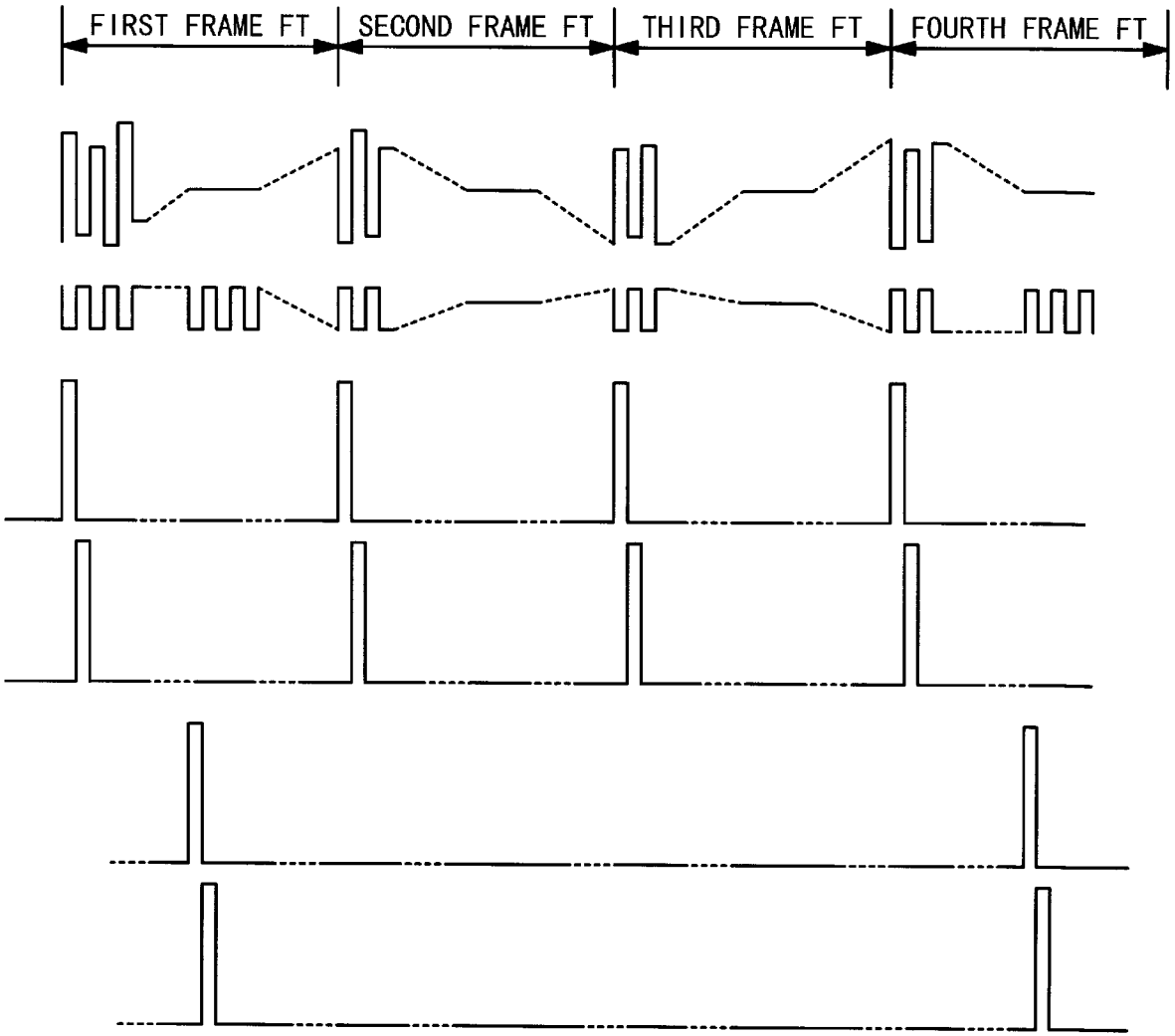
FIG. 12A is a timing chart showing a voltage of a display signal sent to a signal line in yet still another method of driving a TFT type LCD panel of an embodiment of a display apparatus of the present invention.
FIG. 12B is a timing chart showing an opposite common voltage commonly sent to all pixel capacities in yet still another method of driving a TFT type LCD panel of an embodiment of a display apparatus of the present invention.
FIG. 12C is a timing chart showing a voltage of a scanning signal VG1 sent to a scanning line G1 in yet still another method of driving a TFT type LCD panel of an embodiment of a display apparatus of the present invention.
FIG. 12D is a timing chart showing a voltage of a scanning signal VG2 sent to a scanning line G2 in yet still another method of driving a TFT type LCD panel of an embodiment of a display apparatus of the present invention.
FIG. 12E is a timing chart showing a voltage of a scanning signal VGn sent to a scanning line Gn in yet still another method of driving a TFT type LCD panel of an embodiment of a display apparatus of the present invention.
FIG. 12F is a timing chart showing a voltage of a scanning signal VGn+1 sent to a scanning line Gn+1 in yet still another method of driving a TFT type LCD panel of an embodiment of a display apparatus of the present invention.

Furthermore, as shown in FIG. 12B, the further reduction in the consumptive power can be attained by setting the amplitude of the opposite common voltage VCOM at zero, in the period in which the scanning signals VGn, VGn+1 . . . are not sent to the scanning lines Gn, Gn+1 . . . of the second display region 32.

In the embodiment of FIGS. 3A~3F, both the first display region 31 and the second display region 32 employ the row line inversion drive for inverting a signal voltage VS of a next row scanning line to any scanning line within one frame screen. FIGS. 15A~15F show another embodiment. In this embodiment, the first display region 31 employs the row line inversion drive, and the second display region 32 employs the frame inversion drive. In this case, each pixel voltage in the first display region 31 is operated similarly to the embodiment of FIGS. 3A~3F. However, as for each pixel voltage in the second display region 32, the positive potential (the VCOM standard) is charged in the first frame FT. The TFT is not driven in the second and third frames FT, such as VGn, VGn+1 . . . . And, the negative potential (the VCOM standard) is charged in the fourth frame FT. In this way, even the inversion drive operation different for each display region can attain the reduction in the consumptive power.

The configuration for inputting the scanning signals VG1, VG2, . . . , VGn−1, VGn, VGn+1 . . . to each of a plurality of scanning lines G1, G2, . . . Gn−1, Gn, Gn+1 . . . , at the timing shown in FIG. 3 will be described below with reference to FIGS. 4, 5.

Figure 4:
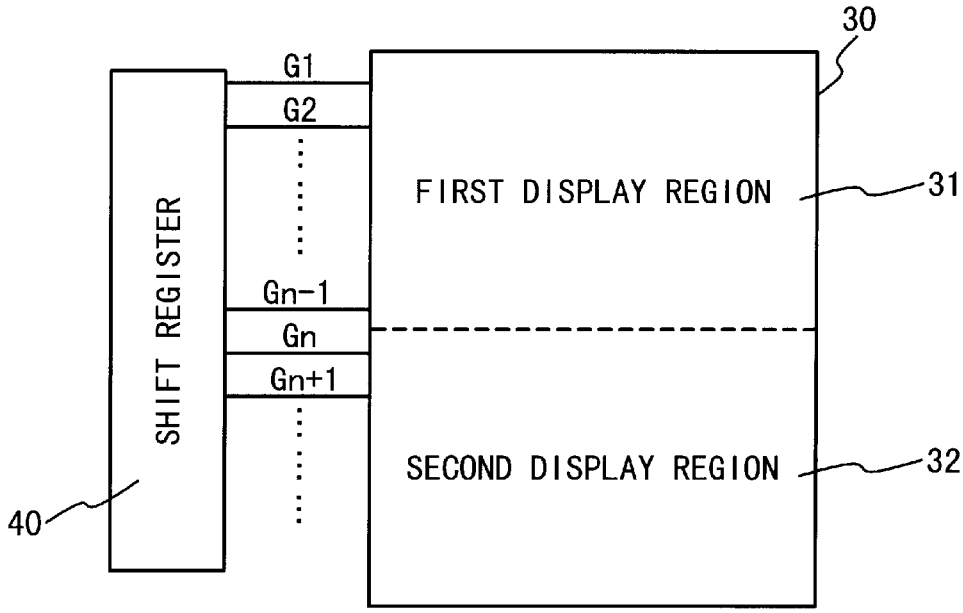
FIG. 4 is a view showing a connection example between a shift register and an LCD panel used in this embodiment.
Figure 5:
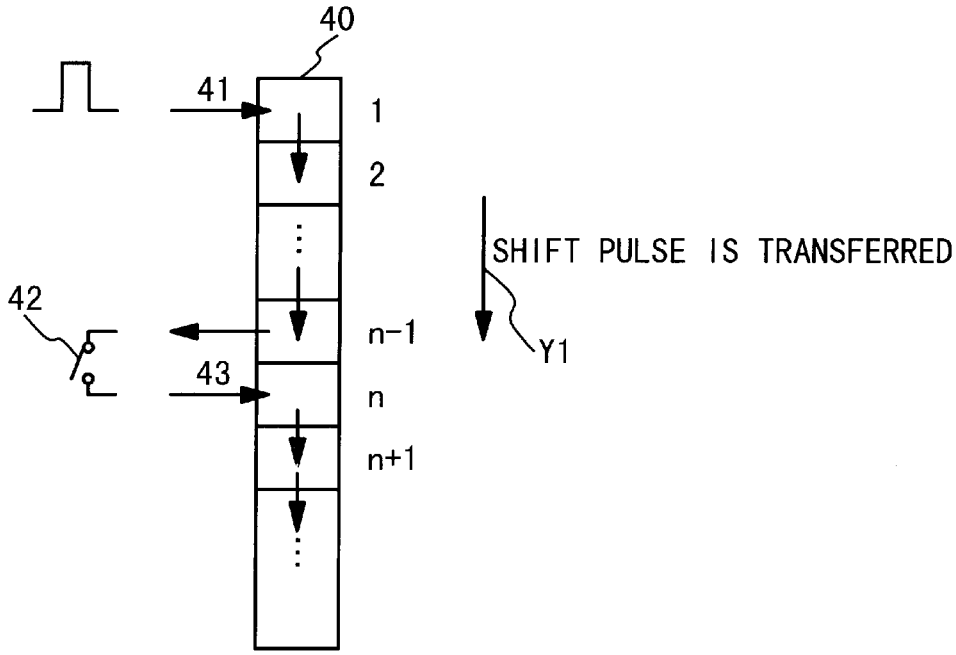
FIG. 5 is a view showing a configuration of a shift register in this embodiment.

In FIGS. 4, 5, a symbol 40 denotes a shift register. As shown in FIG. 4, the shift register 40 is connected to all the scanning lines G1, G2, . . . Gn−1, Gn, Gn+1 . . . of the LCD panel 30. As shown in FIG. 5, a shift pulse is inputted from an input 41 to the shift register 40, and its shift pulse is transferred in a direction of an arrow Y1, in response to a shift clock (not shown). That is, the shift register 40 outputs the scanning signals VG1, VG2, . . . , VGn−1, VGn, VGn+1 . . . to the respective scanning lines G1, G2, . . . Gn−1, Gn, Gn+1 . . . at a predetermined timing.

As shown in FIG. 5, a switch 42 is mounted between the two scanning lines Gn−1, Gn corresponding to a boundary between the first display region 31 and the second display region 32, in the shift register 40. When the switch 42 is turned off, the shift pulse transferred in the direction of the arrow Y1 from the input 41 is not transferred on and after the scanning lines Gn, Gn+1 . . . .

A controller (not shown) is mounted in the shift register 40. This controller counts the predetermined timings (shift clocks), and detects the number of frames FT at this time (which number of frame FT) in accordance with the count result. In the example shown in FIG. 3, the controller turns the switch 42 on, in the first and fourth frames FT. Thus, the scanning signals VG1, VG2, . . . , VGn−1, VGn, VGn+1 . . . are outputted to each of all the scanning lines G1, G2, . . . Gn−1, Gn, Gn+1 . . . at a predetermined timing. The controller turns the switch 42 off, in the second and third frames FT. Hence, the scanning signals VG1, VG2, . . . , VGn−1 are outputted to each of the scanning lines G1, G2, . . . Gn−1 at a predetermined timing. The scanning signals VGn, VGn+1 . . . are not outputted to each of the scanning lines Gn, Gn+1 . . . .

The case in which the second display region 32 is driven in the usual write period and the first display region 31 is driven in the write period longer than that of the second display region 32 will be described below.

As shown in FIG. 5, a second input 43 is mounted at a position corresponding to the scanning line Gn, in the shift register 40. The controller receives a shift pulse from the second input 43, when it does not drive the first display region 31, in accordance with the count result. Its shift pulse is transferred in the direction of the arrow Y1 to thereby drive only the second display region 32. The controller receives a shift pulse from the input 41, when driving the first display region 31, in accordance with the count result. Its shift pulse is transferred in the direction of the arrow Y1 to thereby drive the first and second display regions 31, 32.

The variation in this embodiment will be described below with reference to FIGS. 6, 7.

In FIGS. 1A, 4, the LCD panel 30 is divided into the first display region 31 and the second display region 32. Instead of this division, the LCD panel 30 can be divided into a first display region 31, a second display region 32 and a third display region 33, as shown in FIG. 6. FIG. 7 shows a shift register 50 for driving the LCD panel 30 shown in FIG. 6.

A switch 52 and a switch 53 are mounted in the shift register 50, in addition to the switch 42. The switch 52 is mounted between two scanning lines Gm−1, Gm corresponding to a boundary between the second display region 32 and the third display region 33. And, the switch 53 is mounted between two scanning lines Gn−1, Gm.

When the switch 52 is turned off, the shift pulse transferred in the direction of the arrow Y1 from the input 41 is not transferred on and after the scanning lines Gm, Gm+1 . . . . When the switch 42 is turned off and the switch 53 is turned on, the shift pulse transferred in the direction of the arrow Y1 from the input 41 is not transferred to the scanning lines Gn, Gn+1 . . . , Gm−1. When the switch 42 and the switch 53 are turned off, the shift pulse transferred in the direction of the arrow Y1 from the input 41 is not transferred to the scanning lines Gn, Gn+1 . . . .

A third input 54 is mounted in the shift register 50, in addition to the input 41 and the second input 43. The controller mounted in the shift register 50 receives the shift pulse from any of the input 41, the second input 43 and the third input 54, in accordance with the count result.

Another shift register will be described below with reference to FIG. 13.

Figure 13:
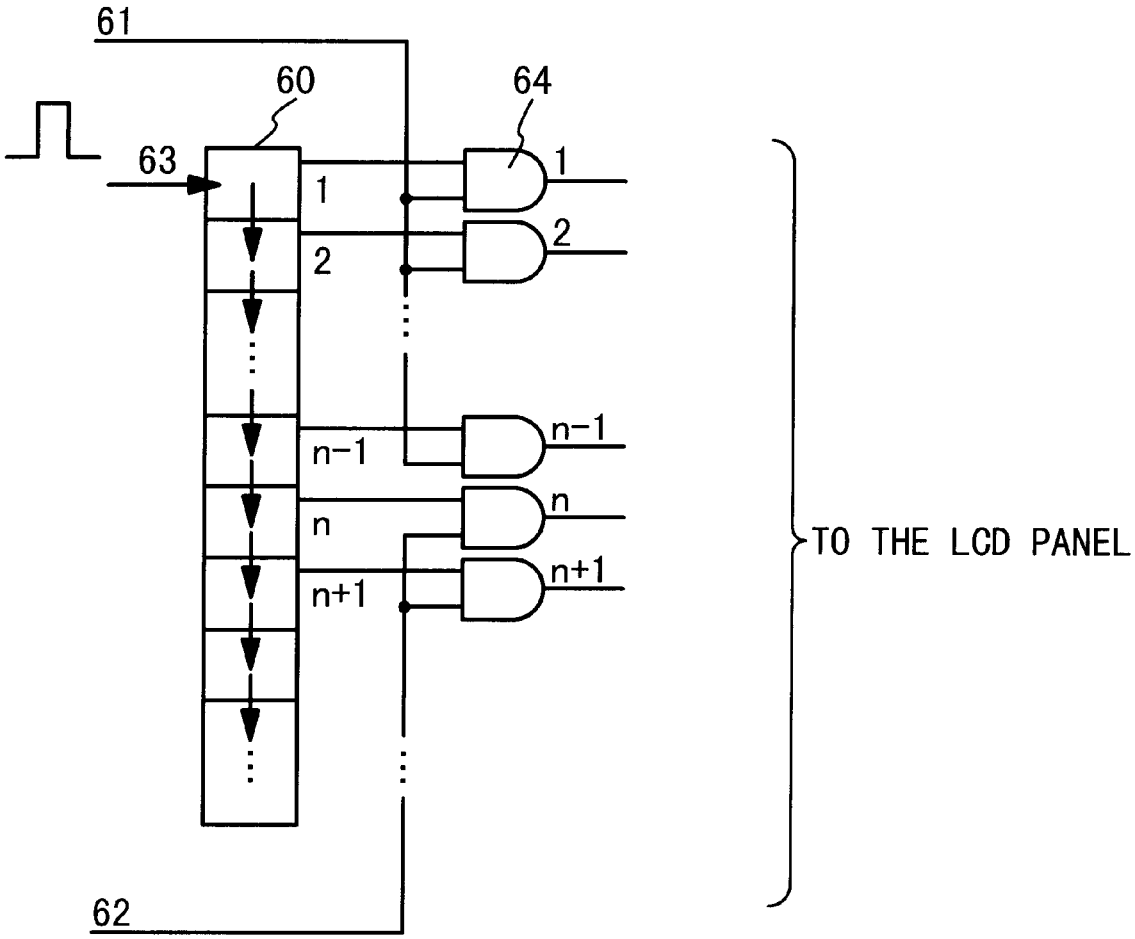
FIG. 13 is a view showing a configuration of another shift register in this embodiment.

As shown in FIG. 13, one input of an AND circuit 64 is connected to an output section of a shift register 60. The other input of the AND circuit 64 is commonly connected to signal lines 61, 62, correspondingly to first scanning line groups G1, G2, . . . Gn−1 of the first display region 31 and second scanning line groups Gn, Gn+1 . . . of the second display region 32, respectively.

If the two signal lines 61, 62 are both at a high level, a pulse signal, which is inputted from an input 63 and sequentially shifted within the shift register 60, is sequentially sent to the first and second scanning line groups G1, G2, . . . , Gn−1, Gn, Gn+1 . . . , as the scanning signal from the AND circuit 64. If the signal line 61 is at the high level and the signal line 62 is at a low level, the scanning signal is sequentially sent to the first scanning line groups G1, G2, . . . Gn−1, and the scanning signal is not sent to the second scanning line groups Gn, Gn+1 . . . .

Thus, the scanning signals VG1, VG2, . . . , VGn−1, VGn, VGn+1 . . . shown in FIGS. 3C~3F can be generated if the two signal lines 61, 62 are both set at the high level in the first frame FT, the signal line 61 is set at the high level and the signal line 62 is set at the low level in the second and third frames FT, and the two signal lines 61, 62 are both set at the high level in the fourth frame FT. On the other hand, if the signal line 62 is always set at the high level and the level of the signal line 61 is switched to the high/low level, the scanning signal is intermittently sent to the first scanning line groups G1, G2, . . . Gn−1.

Another shift register will be described below with reference to FIG. 14.

Figure 6:
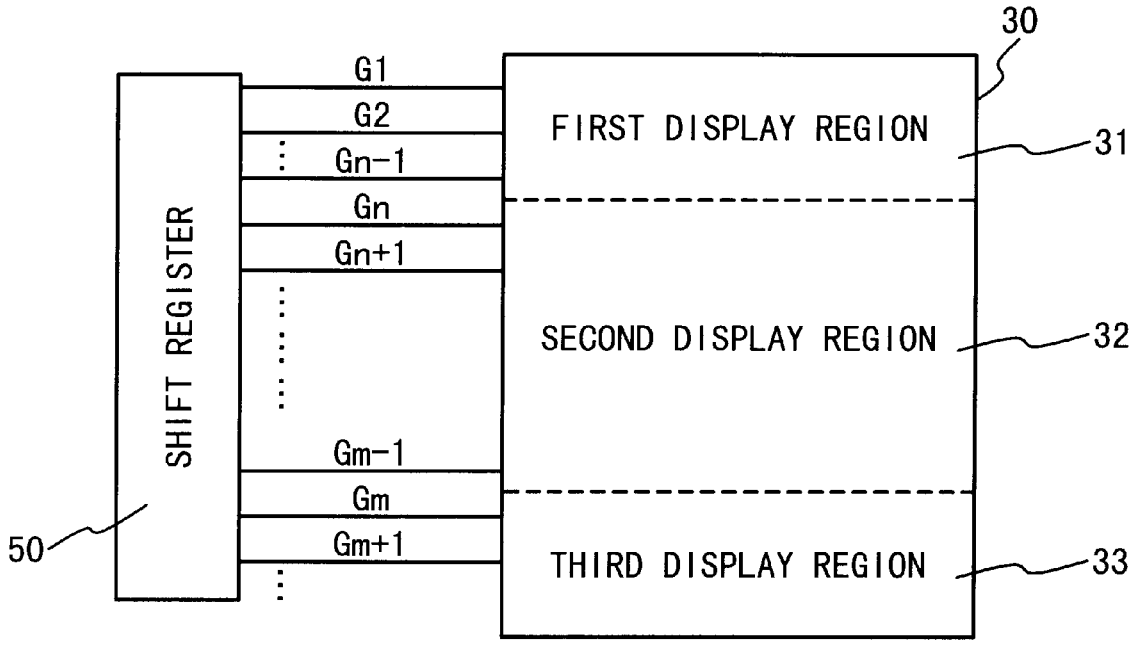
FIG. 6 is a view showing a connection example between a shift register and a three-division LCD panel.
Figure 7:
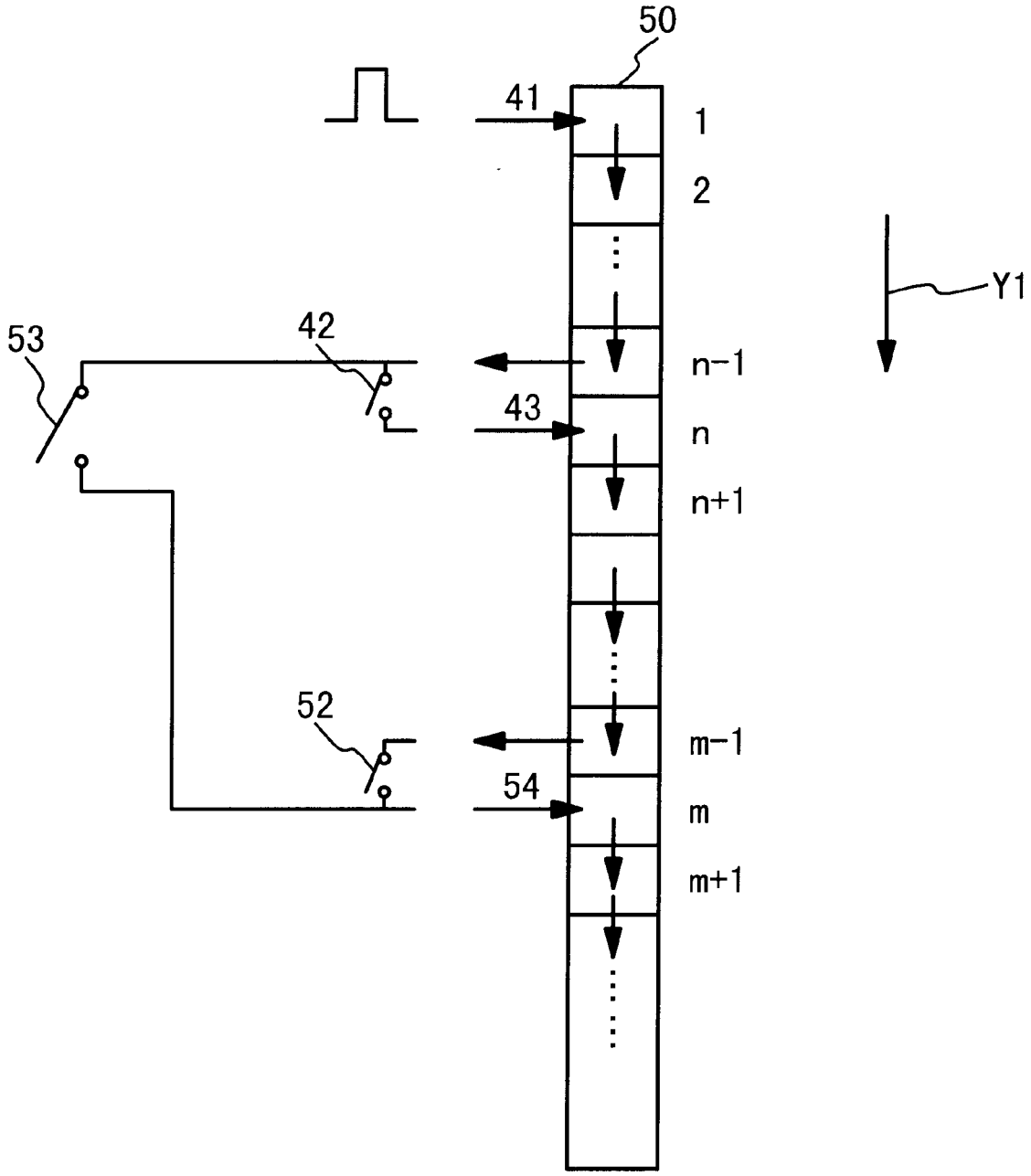
FIG. 7 is a view showing a configuration of a shift register of FIG. 6.
Figure 14:
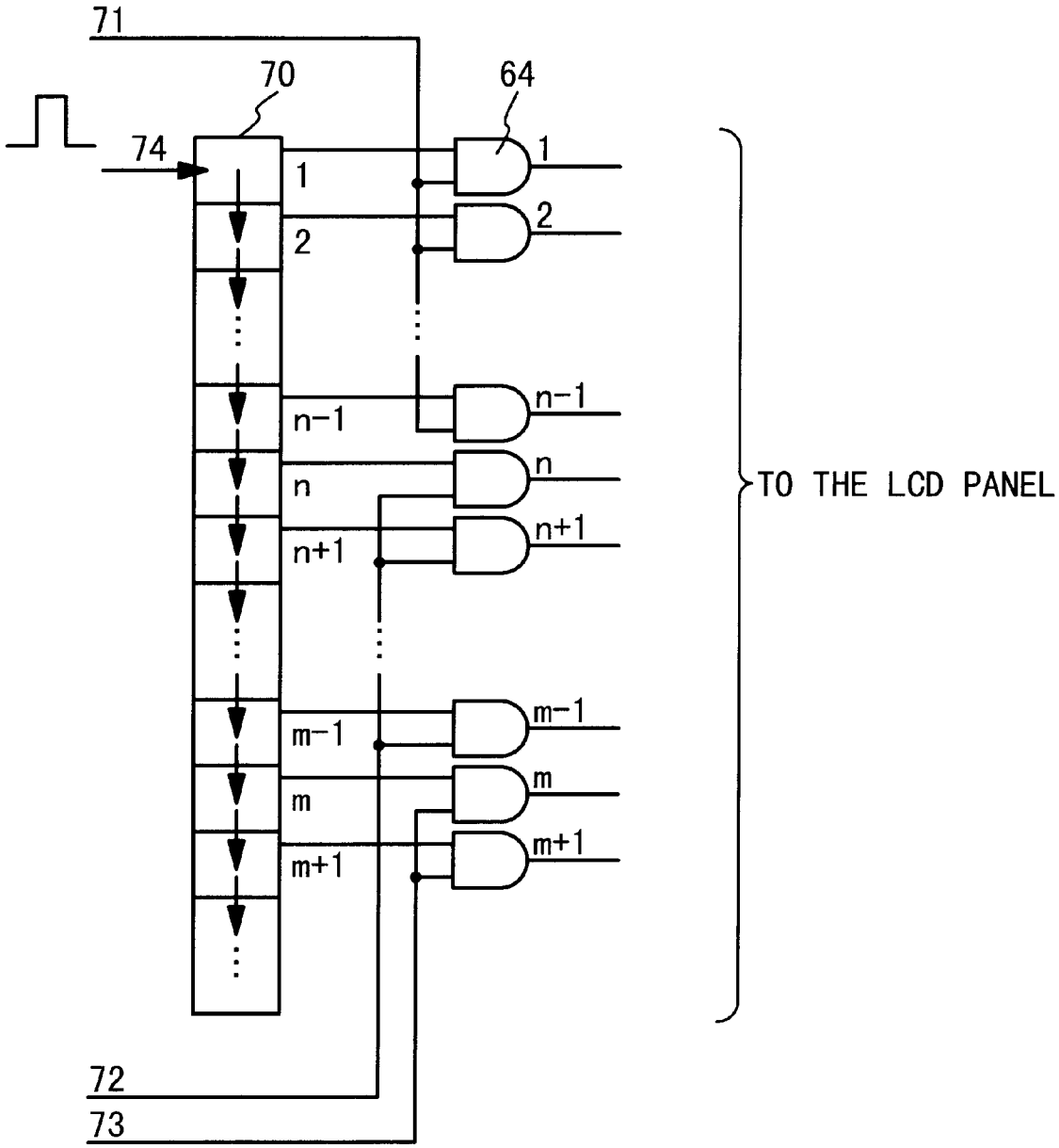
FIG. 14 is a view showing a configuration of still another shift register in this embodiment.
Figures 15A, 15B, 15C, 15D, 15E, 15F:
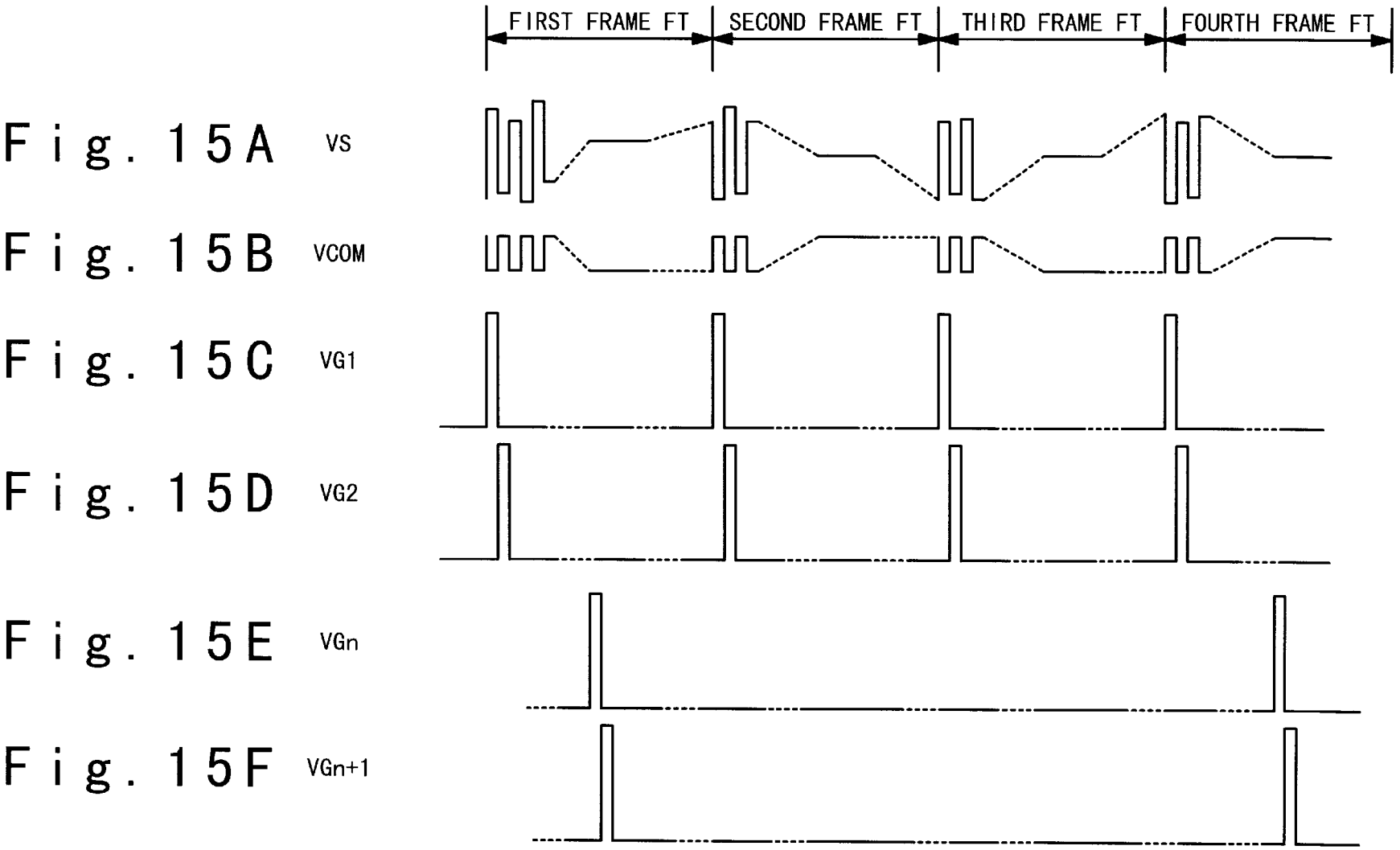
FIG. 15A is a timing chart showing a voltage of a display signal sent to a signal line in yet still another method of driving a TFT type LCD panel of an embodiment of a display apparatus of the present invention.
FIG. 15B is a timing chart showing an opposite common voltage commonly sent to all pixel capacities in yet still another method of driving a TFT type LCD panel of an embodiment of a display apparatus of the present invention.
FIG. 15C is a timing chart showing a voltage of a scanning signal VG1 sent to a scanning line G1 in yet still another method of driving a TFT type LCD panel of an embodiment of a display apparatus of the present invention.
FIG. 15D is a timing chart showing a voltage of a scanning signal VG2 sent to a scanning line G2 in yet still another method of driving a TFT type LCD panel of an embodiment of a display apparatus of the present invention.
FIG. 15E is a timing chart showing a voltage of a scanning signal VGn sent to a scanning line Gn in yet still another method of driving a TFT type LCD panel of an embodiment of a display apparatus of the present invention.
FIG. 15F is a timing chart showing a voltage of a scanning signal VGn+1 sent to a scanning line Gn+1 in yet still another method of driving a TFT type LCD panel of an embodiment of a display apparatus of the present invention.

Even if the display region is divided into three regions as shown in FIG. 6, the other input of the AND circuit 64 is commonly connected to respective signal lines 71, 72 and 73, correspondingly to the divided display regions, as shown in FIG. 14. The pulse signal, which is inputted from an input 74 and sequentially shifted within a shift register 70, is selectively outputted from each of the AND circuits 64, since the levels of the signal lines 71, 72 and 73 are controlled. Accordingly, an input cycle of the scanning signal is variable for each of the display regions 31 to 33.

By the way, in FIGS. 4, 6, 13 and 14, the output of the shift register or the AND circuit is directly connected to the LCD panel. However, an amplifying circuit or a voltage level converting circuit may be mounted at the output of the shift register or the AND circuit, in order to sufficiently drive the TFT.

The following case may be considered as a case that only the second display region 32 among the first, second and third display regions 31, 32 and 33 is driven at the usual write period, and the first and third display regions 31, 33 are driven at the write periods longer than that of the second display region 32. This is the case that if a record medium such as a television broadcast, a movie or the like is reproduced, a difference of an aspect ratio on a screen (4:3 and 16:9) and the like cause black portions to be induced in a top and a bottom of the screen, and a dynamic picture can not be displayed on the black portions. This embodiment is not limited to the above-mentioned portable electronic apparatus, and it can be applied to various displays including a television.

In the above-mentioned explanations, the case that the picture of the second display region 32 is not changed in picture as shown in FIGS. 3E and 3F is described (including the case that the entire surface of the second display region 32 is held in its white color). This embodiment may be a case that instead of the above-mentioned case, a picture corresponding to the lengthened write period (the picture change is slighter as compared with the picture of the first display region 31 based on the usual write period) is displayed on the second display region 32.

The above-mentioned embodiments are described with regard to the LCD based on the active matrix drive method using the three-terminal device. However, the present invention is not limited to them. The present invention can be applied to an apparatus based on a two-terminal device matrix drive method represented by an MIM type.

In a case of the STN type LCD, because of its driving method, the division into the first and second display regions, in which the write periods are different from each other, causes a write time of each pulse to be longer, in the usual write period. Thus, the consumptive power can not be sufficiently reduced. Moreover, the STN type LCD further requires a circuit for changing a bias voltage. Hence, the circuit configuration becomes complex.

In the TFT type LCD of the above-mentioned embodiment, since a gate voltage is not applied to the TFT, its operation is stopped. Thus, the consumptive power can be sufficiently reduced. The TFT type LCD does not require the circuit for changing the bias voltage and the like. Hence, the circuit configuration is simple.

According to the present invention, it is possible to reduce the consumptive power.

What is claimed is:

1. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein said first intervals are selected such that said plurality of capacitance sections of said first display region are driven at alternating currents, and wherein said second intervals are selected such that said plurality of capacitance sections of said second display region are driven at alternating currents.

2. The display apparatus according to claim 1, further comprising:

a first shift resister supplying said plurality of scanning signals to said first group of the scanning lines by transferring a first input signal one by one; and a second shift resister supplying said plurality of scanning signals to said second group of the scanning lines by transferring a second input signal one by one.

3. The display apparatus according to claim 1, further comprising:

a shift resister supplying said plurality of scanning lines to said plurality of scanning signals by transferring an input signal one by one, and wherein said shift resister has a switch to stop transferring said input signal such that said plurality of scanning signals are supplied to said first group of the scanning lines and said plurality of scanning signals are not supplied to said second group of the scanning lines.

4. The display apparatus according to claim 3, wherein said input signal is transferred in a predetermined direction in said shift resister, and wherein a first input section inputting said input signal is provided in the most upstream in said predetermined direction of said first group of the scanning lines in said shift resister, and wherein a second input section inputting said input signal is provided in the most upstream in said predetermined direction of said second group of the scanning lines in said shift resister.

5. The display apparatus according to claim 3, wherein each of said first and second intervals corresponds to a multiple of a period of a frame when a single image is displayed in said display section, and wherein said display apparatus further comprises:

a control section detecting the number of said frames to switch between an ON state and an OFF state of said switch based on the detected result.

6. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein when said plurality of scanning signals are inputted to said second group of the scanning lines, said plurality of display signals inputted to said plurality of capacitance sections of said second display region have amplitudes substantially identical with each other.

7. The display apparatus according to claim 6, further comprising:

a first shift resister supplying said plurality of scanning signals to said first group of the scanning lines by transferring a first input signal one by one; and a second shift resister supplying said plurality of scanning signals to said second group of the scanning lines by transferring a second input signal one by one.

8. The display apparatus according to claim 6, further comprising:

a shift resister supplying said plurality of scanning lines to said plurality of scanning signals by transferring an input signal one by one, and wherein said shift resister has a switch to stop transferring said input signal such that said plurality of scanning signals are supplied to said first group of the scanning lines and said plurality of scanning signals are not supplied to said second group of the scanning lines.

9. The display apparatus according to claim 8, wherein said input signal is transferred in a predetermined direction in said shift resister, and wherein a first input section inputting said input signal is provided in the most upstream in said predetermined direction of said first group of the scanning lines in said shift register, and wherein a second input section inputting said input signal is provided in the most upstream in said predetermined direction of said second group of the scanning lines in said shift resister.

10. The display apparatus according to claim 8, wherein each of said first and second intervals corresponds to a multiple of a period of a frame when a single image is displayed in said display section, and wherein said display apparatus further comprises:

a control section detecting the number of said frames to switch between an ON state and an OFF state of said switch based on the detected result.

11. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein when said plurality of scanning signals are not inputted to said second group of the scanning lines based on a difference between said first and second intervals, a plurality of specific display signals having amplitudes substantially identical with said amplitudes of said plurality of display signals inputted to said plurality of capacitance sections of said second display region when said plurality of scanning signals are inputted to said second group of the scanning lines, are outputted to said plurality of signal lines at the same timings as when said plurality of scanning signals are inputted to said second group of the scanning lines.

12. The display apparatus according to claim 11, wherein said amplitudes of said plurality of specific display signals are substantially zero.

13. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein when said plurality of scanning lines are not inputted to said second group of the scanning lines based on a difference between said first and second intervals, potentials of said plurality of signal lines are dropped at the same timings as when said plurality of scanning signals are inputted to said second group of the scanning lines.

14. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein when said plurality of scanning signals are not inputted to said second group of the scanning lines based on a difference between said first and second intervals, said plurality of signal lines are in floating states at the same timings as when said plurality of scanning signals are inputted to said second group of the scanning lines.

15. A display apparatus, comprising:

a plurality of scanning lines to which a plurality of scanning signals are inputted, respectively;

a plurality of signal lines to which a plurality of displays signals are inputted, respectively;

a plurality of capacitance sections respectively provided through a plurality of switching elements at a plurality of intersections of said plurality of scanning lines and said plurality of signal lines; and a display section including said plurality of capacitance sections, and wherein said display section is divided into first and second display regions by a virtual line parallel to at least one of said plurality of scanning lines, and wherein said plurality of scanning signals are inputted at first intervals to a first group of the scanning lines corresponding to said first display region of said plurality of scanning lines, and wherein said plurality of scanning signals are inputted at second intervals different from said first intervals to a second group of the scanning lines corresponding to said second display region of said plurality of scanning lines, wherein when said plurality of scanning signals are not inputted to said second group of the scanning lines based on a difference between said first and second intervals, potentials of said second group of the scanning lines are dropped at the same timings as when said plurality of scanning signals are inputted to said second group of the scanning lines.

16. A driving method of a display apparatus, comprising:

(a) providing a plurality of scanning lines to which a plurality of scanning signals are inputted, respectively;

(b) providing a plurality of signal lines to which a plurality of display signals are inputted, respectively;

(c) providing a plurality of capacitance sections respectively provided through a plurality of switching elements at a plurality of intersections of said plurality of scanning lines and said plurality of signal lines;

(d) providing a display section including said plurality of capacitance sections;

(e) dividing said display section into first and second display regions by a virtual line parallel to at least one of said plurality of scanning lines;

(f) inputting said plurality of scanning signals at first intervals to a first group of the scanning lines corresponding to said first display region of said plurality of scanning lines; and (g) inputting said plurality of scanning signals at second intervals different from said first intervals to a second group of the scanning lines corresponding to said second display region of said plurality of scanning lines, wherein said first intervals are selected such that said plurality of capacitance sections of said first display region are driven at alternating currents, and wherein said second intervals are selected such that said plurality of capacitance sections of said second display region are driven at alternating currents.

17. A driving method of a display apparatus, comprising:

(a) providing a plurality of scanning lines to which a plurality of scanning signals are inputted, respectively;

(b) providing a plurality of signal lines to which a plurality of display signals are inputted, respectively;

(c) providing a plurality of capacitance sections respectively provided through a plurality of switching elements at a plurality of intersections of said plurality of scanning lines and said plurality of signal lines;

(d) providing a display section including said plurality of capacitance sections;

(e) dividing said display section into first and second display regions by a virtual line parallel to at least one of said plurality of scanning lines;

(f) inputting said plurality of scanning signals at first intervals to a first group of the scanning lines corresponding to said first display region of said plurality of scanning lines; and (g) inputting said plurality of scanning signals at second intervals different from said first intervals to a second group of the scanning lines corresponding to said second display region of said plurality of scanning lines, wherein when said plurality of scanning signals are inputted to said second group of the scanning lines, said plurality of display signals inputted to said plurality of capacitance sections of said second display region have amplitudes substantially identical with each other.

18. A driving method of a display apparatus, comprising:

(a) providing a plurality of scanning lines to which a plurality of scanning signals are inputted, respectively;

(b) providing a plurality of signal lines to which a plurality of display signals are inputted, respectively;

(c) providing a plurality of capacitance sections respectively provided through a plurality of switching elements at a plurality of intersections of said plurality of scanning lines and said plurality of signal lines;

(d) providing a display section including said plurality of capacitance sections;

(e) dividing said display section into first and second display regions by a virtual line parallel to at least one of said plurality of scanning lines;

(f) inputting said plurality of scanning signals at first intervals to a first group of the scanning lines corresponding to said first display region of said plurality of scanning lines; and (g) inputting said plurality of scanning signals at second intervals different from said first intervals to a second group of the scanning lines corresponding to said second display region of said plurality of scanning lines, wherein when said plurality of scanning signals are not inputted to said second group of the scanning lines based on a difference between said first and second intervals, a plurality of specific display signals having amplitudes substantially identical with said amplitudes of said plurality of display signals inputted to said plurality of capacitance sections of said second display region when said plurality of scanning signals are inputted to said second group of the scanning lines, are outputted to said plurality of signal lines at the same timings as when said plurality of scanning signals are inputted to said second group of the scanning lines.

* * * * *